US012408766B2

(12) United States Patent
Smedley et al.

(10) Patent No.: US 12,408,766 B2
(45) Date of Patent: Sep. 9, 2025

(54) FLAT RACK WITH EXTENDER

(71) Applicant: Fasteners for Retail, Inc., Twinsburg, OH (US)

(72) Inventors: Jamie A. Smedley, Hudson, OH (US); William Joseph Mertz, Cincinnati, OH (US); Shane Obitts, North Ridgeville, OH (US); William H. Walker, Fairlawn, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 435 days.

(21) Appl. No.: 17/954,863

(22) Filed: Sep. 28, 2022

(65) Prior Publication Data

US 2023/0114411 A1 Apr. 13, 2023

Related U.S. Application Data

(60) Provisional application No. 63/253,832, filed on Oct. 8, 2021.

(51) Int. Cl.
*A47F 3/06* (2006.01)
*A47F 3/04* (2006.01)

(52) U.S. Cl.
CPC ..... *A47F 3/06* (2013.01); *A47F 3/0426* (2013.01)

(58) Field of Classification Search
CPC ..... A47F 3/0426; A47F 3/0486; A47F 3/06; A47F 5/0018; A47F 5/0037;
(Continued)

(56) References Cited

U.S. PATENT DOCUMENTS 2,685,372 A * 8/1954 Palaith ..... A47B 96/025 211/153
2,830,706 A * 4/1958 Canning ..... A47B 45/00 211/186
(Continued)

FOREIGN PATENT DOCUMENTS

CN 112401578 A * 2/2021 ..... A47F 3/004
DE 8607337 U1 7/1986
(Continued)

*Primary Examiner* — Andrew Roersma
(74) *Attorney, Agent, or Firm* — Reinhart Boerner Van Deuren P.C.

(57) ABSTRACT

An adjustable rack system, a shelving system, and methods are provided. The adjustable rack system includes an adjustable frame and an adjustable rack. The adjustable frame includes a front rail, a rear rail and at least one longitudinally adjustable rail. The longitudinally adjustable rail interconnects the front and rear rails. The longitudinally adjustable rail is longitudinally adjustable in length to adjust the spacing between the front and rear rails along an adjustment axis. The adjustable rack is removably attached to the adjustable frame. The adjustable rack includes a first panel defining a rear edge of the adjustable rack and a second panel defining a front edge of the adjustable rack. The second panel is adjustably positionable relative to the first panel to adjust a spacing between the front and rear edge of the adjustable rack. The adjustable rack defines a top surface defined in part by each of the first and second panels.

29 Claims, 23 Drawing Sheets

(58) Field of Classification Search
CPC .... A47F 5/0043; A47F 5/0081; A47F 5/0087; A47F 5/0093; A47F 5/12; A47B 96/025; A47B 45/00
See application file for complete search history.

(56) References Cited

U.S. PATENT DOCUMENTS 2,948,405 A * 8/1960 Smith ..... A47B 61/003 108/30
3,221,677 A * 12/1965 Kerr ..... A47B 45/00 108/143
3,385,453 A * 5/1968 Dantino ..... A47F 5/12 312/351
3,765,344 A * 10/1973 Ferdinand ..... A47B 45/00 108/182
3,896,718 A 7/1975 Giambalvo
4,084,703 A * 4/1978 Hossalla ..... A47B 96/025 211/153
4,478,337 A * 10/1984 Flum ..... A47F 1/12 220/8
4,519,508 A * 5/1985 Gullett ..... A47F 1/12 211/175
4,662,523 A * 5/1987 Stein ..... A47F 5/12 211/153
6,021,908 A * 2/2000 Mathews ..... A47F 3/0443 211/175
9,033,438 B2 5/2015 Kelly et al.
9,408,478 B2 * 8/2016 Vogler ..... A47F 5/0093
9,782,019 B2 * 10/2017 Narayanachar ..... A47F 3/0426
2006/0016774 A1 * 1/2006 Bustos ..... A47B 96/1466 211/186
2012/0000867 A1 * 1/2012 Saving ..... A47B 45/00 235/494
2012/0074087 A1 * 3/2012 Neumann ..... A47B 45/00 211/134
2021/0227999 A1 * 7/2021 Smedley ..... A47B 45/00

FOREIGN PATENT DOCUMENTS

DE 20014333 U1 * 1/2002 ..... A47F 5/0043
DE 202015007583 U1 * 3/2017 ..... A47F 5/12
WO WO 2004/060119 A1 7/2004

* cited by examiner

FLAT RACK WITH EXTENDER

CROSS-REFERENCE TO RELATED PATENT APPLICATIONS

This patent application claims the benefit of U.S. Provisional Patent Application No. 63/253,832, filed Oct. 8, 2021, the entire teachings and disclosure of which are incorporated herein by reference thereto.

FIELD OF THE INVENTION

This invention generally relates to retail display systems and adjustable racks for retail display systems.

BACKGROUND OF THE INVENTION

Retail display systems such as shelving systems are used for displaying merchandise. One particularly shelving system is a refrigerated case that has one or more shelves for displaying merchandise. Some refrigerated cases often have a well formed at a bottom region thereof. The bottom most shelf, which may also be referred to as a rack, often covers a portion of the well that holds components of the system such as pumps, controllers, electrical wiring, hoses, refrigeration components, etc.

Overtime, dust, dirt, grime, and product can get into the well and below the bottom most shelf. Further, maintenance is often required on the components of the system stored below the bottom most shelf. Easy and efficient access to the region below the bottom most shelf can make cleaning easier and more cost effective.

Often, the bottom most shelf is provided by a wire shelf made from interconnected pieces of round wire. Typically, the surface area of these shelves have a greater percentage of openings than surface area provided by the wires. This can make these shelves difficult to clean. For example, it is quite often required to clean around the wire rather than simply clean a flat surface, making complete cleaning difficult.

Further, by being made from wire, these shelves can be relatively heavy.

Further, these wire shelves typically require entire removal of the shelf from the display system to access the well below the shelves. One problem when an entire shelf is removed, it may be difficult to remember the proper orientation to reinstall the shelves. This is particularly true if the person cleaning the shelf is not the person who originally staged the shelving system or that has to reassemble the shelving system after cleaning. For instance, it is quite often that the person cleaning the shelving system is not the person who reassembles the shelving system as the shelving system may need a period of time to dry prior to reassembly.

In some systems, there are plenums below the bottom most product shelf/rack that cover components of the system as noted above (e.g. pumps, fans, hoses, controllers, etc.). In prior systems, it was often necessary to retire the entire bottom most shelf to provide access to or movement of the plenums to allow for cleaning thereunder.

Examples of the present application provide improvements over the current state of the art for shelving systems and particularly shelving systems that have a well formed at the bottom region thereof.

BRIEF SUMMARY OF THE INVENTION

In an example, an adjustable rack system for mounting to a frame assembly of a shelving unit is provided. The adjustable rack system includes an adjustable frame and an adjustable rack. The adjustable frame includes a front rail, a rear rail and at least one longitudinally adjustable rail. The rear rail is spaced from the front rail. The longitudinally adjustable rail interconnects the front and rear rails. The at least one longitudinally adjustable rail is longitudinally adjustable in length to adjust the spacing between the front and rear rails along an adjustment axis. The adjustable rack is removably attached to the adjustable frame. The adjustable rack includes a first panel defining a rear edge of the adjustable rack and a second panel defining a front edge of the adjustable rack. The second panel is adjustably positionable relative to the first panel to adjust a spacing between the front and rear edge of the adjustable rack. The adjustable rack defines a top surface defined in part by each of the first and second panels.

In one example, the at least one longitudinally adjustable rail includes a first and a second side rail that interconnect the rear and front rails. The second side rail is laterally spaced apart from the first side rail. The first and second side rails being longitudinally adjustable to adjust a length thereof parallel to the adjustment axis.

In one example, each of the first and second side rails includes a front side rail member and a rear side rail member. The front side rail member is adjustably positionable relative to the rear side rail member to adjust the length of the corresponding side rail. The front side rail members are attached to the front rail. The rear side rail members re attached to the rear rail.

In one example, the first panel is operably attached to the rear rail and the second panel is operably attached to the front rail such that the first panel and rear rail move together as a unit relative to the front rail and the second panel to adjust spacing between the front and rear edges along the adjustment axis.

In one example, the longitudinally adjustable rail includes a first rail member and a second rail member. The first rail member is attached to the front rail. The second rail member is attached to the rear rail. The second rail member is slidably connected to the first rail member to adjust the length of the longitudinally adjustable rail along the adjustment axis. The first panel is operably attached to the rear rail by being directly attached to the second rail member. The second panel is operably attached to the front rail by being directly attached to the first rail member.

In one example, the first and second panels are removable from the frame simultaneously as a single unit.

In one example, a first panel connector connects the first panel to a rear portion of the adjustable frame. The interaction between the first panel connector and the rear portion of the adjustable frame fixes the first panel relative to the rear portion of the adjustable frame along the adjustment axis. A second panel connector connects the second panel to a front portion of the adjustable frame. The interaction between the first connector and the front portion of the adjustable frame fixes the second panel relative to the front portion of the adjustable frame along the adjustment axis. The front and rear portions of the adjustable frame being movable relative to one another along the adjustment axis.

In one example, the first panel connector is provided by at least one of a pin, a plug, and/or a projection formed by the first panel. The second panel connector is provided by at least one of a pin, a plug, and/or a projection formed by the second panel.

In one example, the first panel includes at least one mounting projection extending downward below the top surface. The at least one mounting projection extends into a mounting aperture formed in a rear portion of the adjustable frame. The interaction between the at least one mounting projection and mounting aperture fixes the first panel relative to the rear portion of the adjustable frame along the adjustment axis. The second panel includes at least one mounting projection extending downward below the top surface. The at least one mounting projection extends into a mounting aperture formed in a front portion of the adjustable frame. The interaction between the at least one mounting projection and mounting aperture fixes the second panel relative to the front portion of the adjustable frame along the adjustment axis. The front and rear portions of the adjustable frame being movable relative to one another along the adjustment axis.

In one example, the rear portion of the adjustable frame is movable relative to the front portion of the adjustable frame along the adjustment axis.

In one example, the first panel includes at least one mounting projection that extends downward below the top surface. The at least one mounting projection extends into a mounting aperture formed in the rear rail. The interaction between the at least one mounting projection and mounting aperture fixes the first panel relative to the rear rail along the adjustment axis. The second panel includes at least one mounting projection that extends downward below the top surface. The at least one mounting projection extends into a mounting aperture formed in the front rail. The interaction between the at least one mounting projection and mounting aperture fixing the second panel relative to the front rail along the adjustment axis.

In one example, the at least one mounting projection of the first panel is formed by an annular wall that surrounds an aperture extending through the first panel and through the top surface. The at least one mounting projection of the second panel is formed by an annular wall that surrounds an aperture extending through the second panel and through the top surface.

In one example, the at least one mounting projections of the first and second panels are sized for receipt of one or more fingers of a user to allow the user to grasp the corresponding first or second panel to remove the adjustable rack from the adjustable frame.

In one example, an intermediate rail extends between and interconnects the first and second side rails. The second panel includes a channel formed in an underside thereof that receives the intermediate rail.

In one example, the first and second panels have a sliding interlock therebetween. When coupled, the sliding interlock permits the first panel to slide relative to the second panel along the adjustment axis but prevents the first and second panels from being disconnected from one another in a direction generally orthogonal to the top surface.

In one example, the sliding interlock includes at least one clip provided one of the first and second panels. The sliding interlock includes a slide region of the other one of the first and second panels that is slidingly engaged by the at least one clip. The slide region being generally parallel to the adjustment axis.

In one example, the slide region includes a notch sized to receive the at least one clip therethrough generally orthogonal to the top surface for assembling the sliding interlock.

In one example, the sliding interlock includes first and second clips provided by one of the first and second panels. The first and second clips are spaced apart from one another in a lateral direction being generally perpendicular to the adjustment axis. First and second slide regions are provided by the other one of the first and second panels. The first clip slidingly engages the first slide region for sliding motion parallel to the adjustment axis but prevents disconnection generally orthogonal to the top surface. The second clip slidingly engages the second slide region for sliding motion parallel to the adjustment axis but prevents disconnection generally orthogonal to the top surface.

In one example, the sliding interlock includes first and second clips provided by the first panel. Each of the first and second clips includes a leg extending downward from a first main panel section of the first panel and a foot portion extending laterally from the leg. The foot and a bottom of the first main panel section forming a channel therebetween. First and second slide regions are provided by a second main panel section of the second panel. The first slide region is received in the channel formed by the first clip. The second slide region is received in the channel formed by the second clip.

In one example, the foot of the first clip extends towards the foot of the second clip. The first and second slide regions are positioned laterally between the legs of the first and second clips.

In one example, the second main panel includes a first notch adjacent the first slide region and a second notch adjacent the second slide region. The first and second notches are sized and configured such that the foot of the first clip can pass through the first notch to align the first slide region with the channel of the first clip and the foot of the second clip can pass through the second notch to align the second slide region with the channel of the second clip.

In one example, the first notch is formed between opposed ends of the first slide region such that a first portion of the first slide region is on a first side of the first notch and a second portion of the first slide region is on a second side of the first notch. The second notch is formed between opposed ends of the second slide region such that a first portion of the second slide region is on a first side of the second notch and a second portion of the second slide region is on a second side of the first notch.

In one example, the adjustable frame includes a first rear frame mount. The first rear frame mount includes an exposed portion that extends rearward of a rear side of the rear rail. The exposed portion includes a downward opening notch. The adjustable frame includes a first front frame mount. The first front frame mount includes an exposed portion that extends forward of a front side of the front rail. The exposed portion includes a downward opening notch.

In one example at least two rear frame mounts or at least two front frame mounts are provided such that at least three frame mounts are provided to improve stability of the adjustable rack system, when mounted to the shelving frame.

In one example, the first rear frame mount is removably attached to the rear rail. The first rear frame mount includes a first leg and a second leg extending from the first leg forming an L-shape. The first leg is longer than the second leg. The downward opening notch is formed in the exposed portion of the first leg. The first leg has a second portion located forward of the rear side of the rear rail. The second portion, at least in part, secures the first rear frame mount to the rear rail. The first front frame mount is removably attached to the front rail. The first front frame mount includes a first leg and a second leg extending from the first leg forming an L-shape. The first leg is longer than the second leg. The downward opening notch is formed in the exposed portion of the first leg. The first leg has a second portion located rearward of the front side of the front rail.

The second portion, at least in part, secures the first front frame mount to the front rail.

In one example, the rear rail includes a top wall, a bottom wall vertically spaced from the top wall, and a rear wall below the top wall. The rear wall defines the rear side of the rear rail. The rear wall defines an opening through which the first leg of the first rear frame mount extends. The bottom wall defines an opening through which the second leg of the first rear frame mount extends. The front rail includes a top wall, a bottom wall vertically spaced from the top wall, and a front wall below the top wall. The front wall defines the front side of the front rail, the front wall defines an opening through which the first leg of the first front frame mount extends. The bottom wall defines an opening through which the second leg of the first front frame mount extends.

In one example, the rear rail includes a yoke defining a cavity that receives the second portion of the first leg of the first rear frame mount. The yoke is positioned between the rear wall and the opening in the bottom wall of the rear rail. The opening in the bottom wall of the rear rail is elongated in a lateral direction and sized to permit the first rear frame mount to be rotated from an orientation wherein the second leg is generally horizontal to an orientation wherein the second leg of the first rear frame mount extends vertically downward to insert the second leg of the of the first rear frame mount into the opening in the bottom wall. Insertion of the second leg of the first rear frame mount into the opening in the bottom wall limits motion of the first rear frame mount parallel to the adjustment axis. The front rail includes a yoke defining a cavity that receives the second portion of the first leg of the first front frame mount. The yoke is positioned between the front wall and the opening in the bottom wall of the front rail. The opening in the bottom wall of the front rail is elongated in a lateral direction and sized to permit the first front frame mount to be rotated from an orientation wherein the second leg of the first front frame mount is generally horizontal to an orientation wherein the second leg of the first front frame mount extends vertically downward to insert the second leg of the of the first front frame mount into the opening in the bottom wall. Insertion of the second leg of the first front frame mount into the opening in the bottom wall limits motion of the first rear frame mount parallel to the adjustment axis.

In one example, the yoke of the rear rail extends downward from the top wall of the rear rail and the yoke of the front rail extends downward from the top wall of the front rail.

In one example, the rear rail includes a rear wall. The rear wall defines an opening through which the first rear frame mount extends. The first rear frame mount includes an upward opening notch. The upward opening notch receives a portion of the rear wall forming part of the opening through which the rear frame mount extends. The front rail includes a front wall. The front wall defines an opening through which the first front frame mount extends. The first front frame mount includes an upward opening notch. The upward opening notch receives a portion of the front wall forming part of the opening through which the front frame mount extends.

In one example, the first rear frame mount includes an upward opening notch. The upward opening notch receives a portion of the rear rail. Engagement provided by the notch and the portion of the rear rail prevents movement of the first rear frame mount relative to the rear rail along the adjustment axis. The first front frame mount includes an upward opening notch. The upward opening notch receives a portion of the front rail. Engagement provided by the notch and the portion of the front rail prevents movement of the first front frame mount relative to the front rail along the adjustment axis.

In one example, the top surface of the adjustable rack includes a plurality of upward extending ribs and a plurality of apertures formed therethrough.

In one example, the plurality of upward extending ribs are provided by the first panel and the plurality of apertures are provided by the second panel.

In an example, a frame mount for mounting a rack frame to a shelving unit frame is provided. The frame mount includes a first leg and a second leg extending from the first leg in a first direction forming an L-shape. The first leg is longer than the second leg. A first notch is formed in first leg. The notch opens in the first direction.

In one example, the first and second legs are formed from a continuous piece of material.

In one example, the continuous piece of material is a bent wire.

In one example, a second notch is provided that opens in a second direction being opposite the first direction such that the first and second notches are on opposite sides of the first leg.

In one example, the second notch is located axially along the first leg between the first notch and the second leg.

In one example, the first notch extends axially along the first leg a greater distance than the second notch.

In one example, the second notch is axially offset from the first notch along a length of the first leg.

In an example, a shelving system including a shelving frame an adjustable rack system as outlined above is provided. The shelving frame includes a rear mounting wall and a front mounting wall. The rear mounting wall extends vertically a first height and the front mounting wall extends vertically a second height that is less than the first height. The front mounting wall is spaced forward of the rear mounting wall. The rear mounting wall and front mounting wall form a well therebetween below a top end of the front mounting wall. The adjustable rack is mounted to the rear mounting wall and the front mounting wall with the front edge of the adjustable rack at or below the top end of the front mounting wall of the shelving frame.

In one example, the adjustable rack of the adjustable rack system is removable from the shelving frame without removing the adjustable frame from the shelving frame.

In one example, a shelf arrangement providing a product support surface is mounted to the rear mounting wall. The product support surface is located vertically above the top end of the front wall.

In one example, the front edge of the adjustable rack is positioned a first distance from the rear mounting wall. A front edge of the shelf arrangement is positioned a second distance from the rear mounting wall.

In one example, the rear mounting wall includes a first plurality of vertically spaced mounting apertures. The front mounting wall includes a second plurality of vertically spaced mounting apertures. The adjustable rack system is selectively mountable within the first and second plurality of vertically spaced mounting apertures to adjust a height and/or slant of the adjustable rack system relative to the shelving frame.

In one example, a shelf arrangement providing a product support surface. The product support surface is located vertically above the top end of the front wall. The rear mounting wall includes a third plurality of vertically spaced mounting apertures that is different than the first plurality of mounting apertures. The shelf arrangement is mounted to the third plurality of vertically spaced mounting apertures.

In one example, the third plurality of vertically spaced mounting apertures includes apertures that are vertically above all of the apertures of the first and second plurality of vertically spaced mounting apertures.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
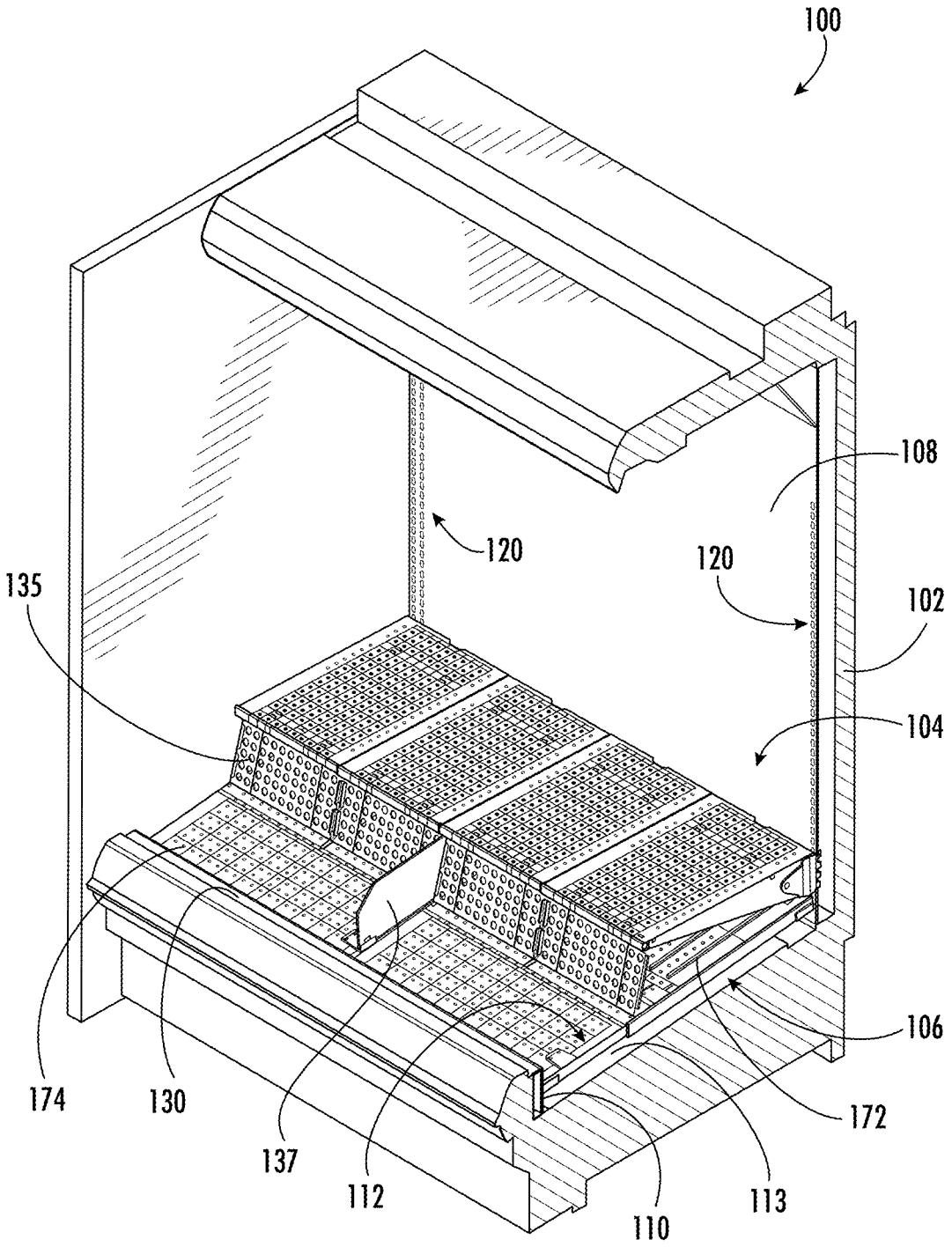
FIG. 1 is a cross-sectional perspective view of a retail merchandise display in the form of a shelving system according to an example of the invention.

FIG. 1 illustrates an example of a retail merchandise display in the form of a shelving system 100. The shelving system 100 may take the form of a refrigerated case for displaying retail merchandise such as produce or other food items that are to be cooled including, but not limited to yogurt, cheeses, milk, beverages, etc. The shelving system 100 includes a shelving frame 102 that supports one or more shelf arrangements 104 and one or more adjustable rack systems 106.

The shelving frame 102 includes a rear mounting wall 108 and a front mounting wall 110 that is spaced apart from the rear mounting wall 108. The shelf arrangement 104 is mounted in a cantilevered fashion from the shelving frame 102 and the adjustable rack system 106 is mounted to and between the rear mounting wall 108 and front mounting wall 110. The shelf arrangement 104 provides a product support surface upon which products are displayed.

Figure 2:
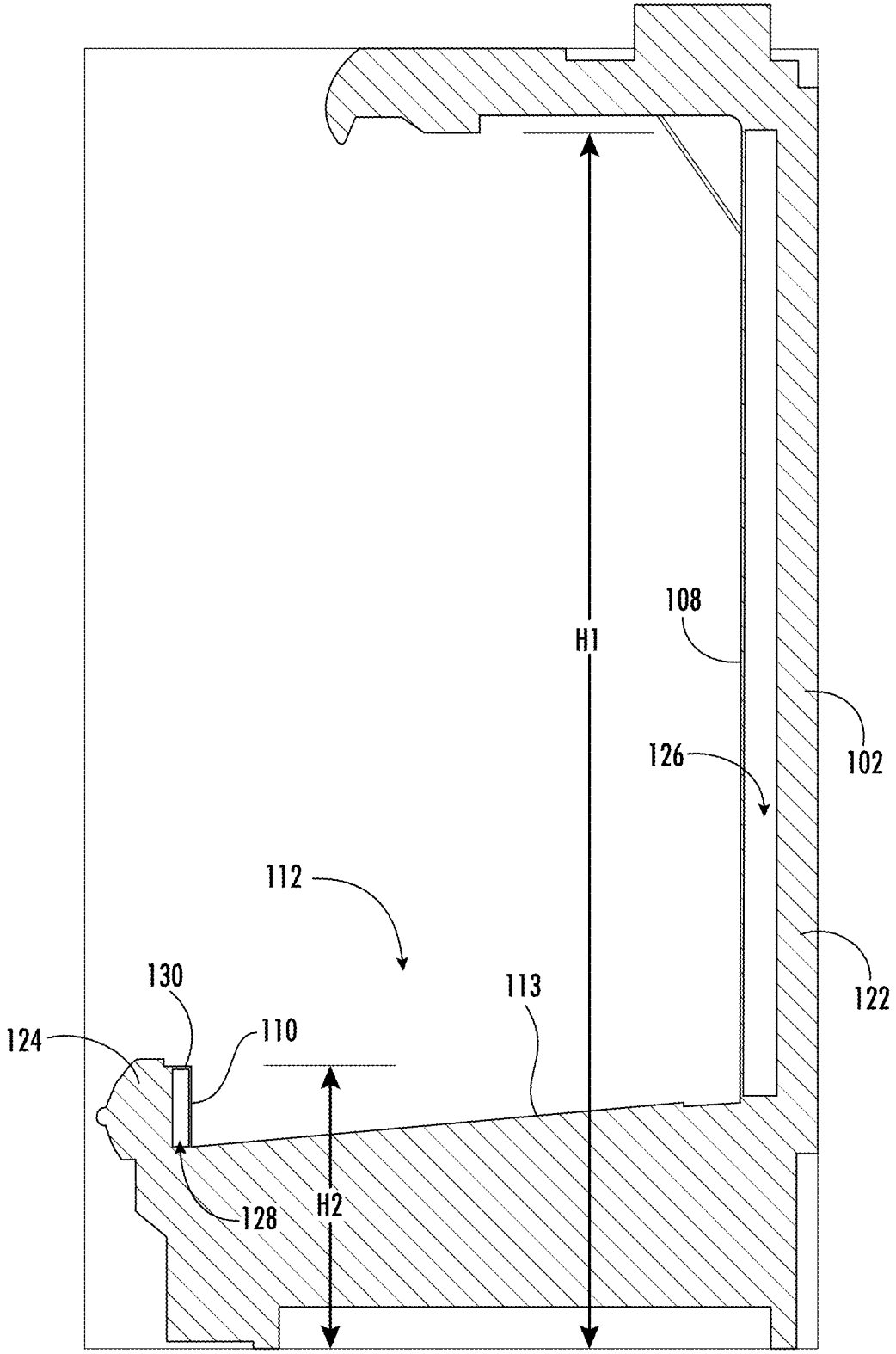
FIG. 2 is a cross-sectional illustration of the shelving system of FIG. 1.

With additional reference to FIG. 2, the shelving system 100, in this example, defines a well 112 between the rear and front mounting walls 108, 110. The well 112 includes a bottom 113. In some embodiments, a set of plenums may be interposed between the bottom 113 and the adjustable rack system 106.

The rear mounting wall 108 includes a plurality of vertically spaced rack mounting apertures 114. With reference to FIG. 4, in this example, the rack mounting apertures 114 in the rear mounting wall 108 are grouped in vertical sets of three rack mounting apertures 114. Similarly, the front mounting wall 110 includes a plurality of vertically spaced rack mounting apertures 116 (see e.g. FIG. 3). In this example, the rack mounting apertures 116 in the front mounting wall are grouped in vertical sets of three rack mounting apertures 116.

Figure 3:
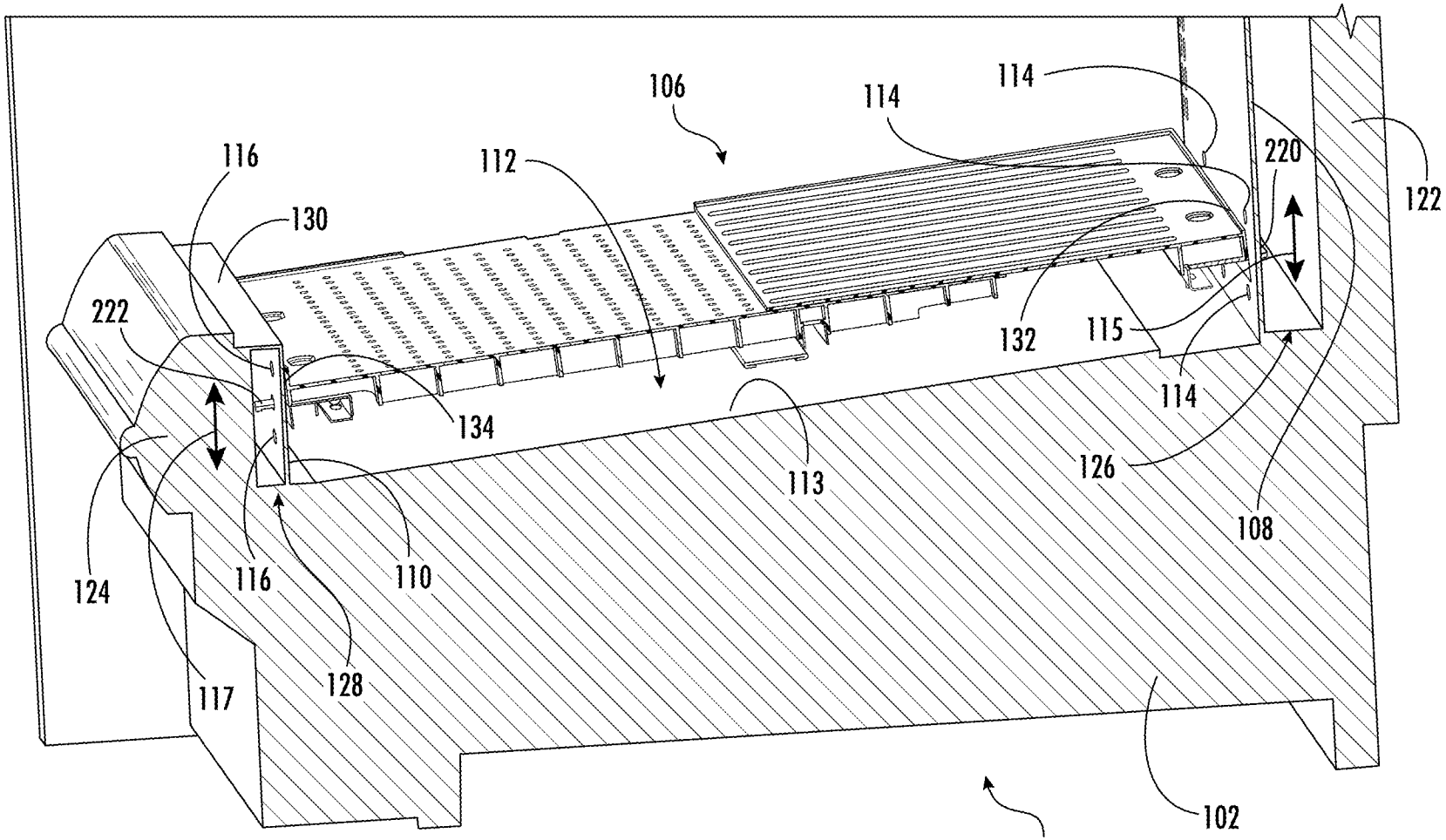
FIG. 3 is an enlarged partial cross-sectional illustration of the well of the shelving system of FIG. 1.
Figure 4:
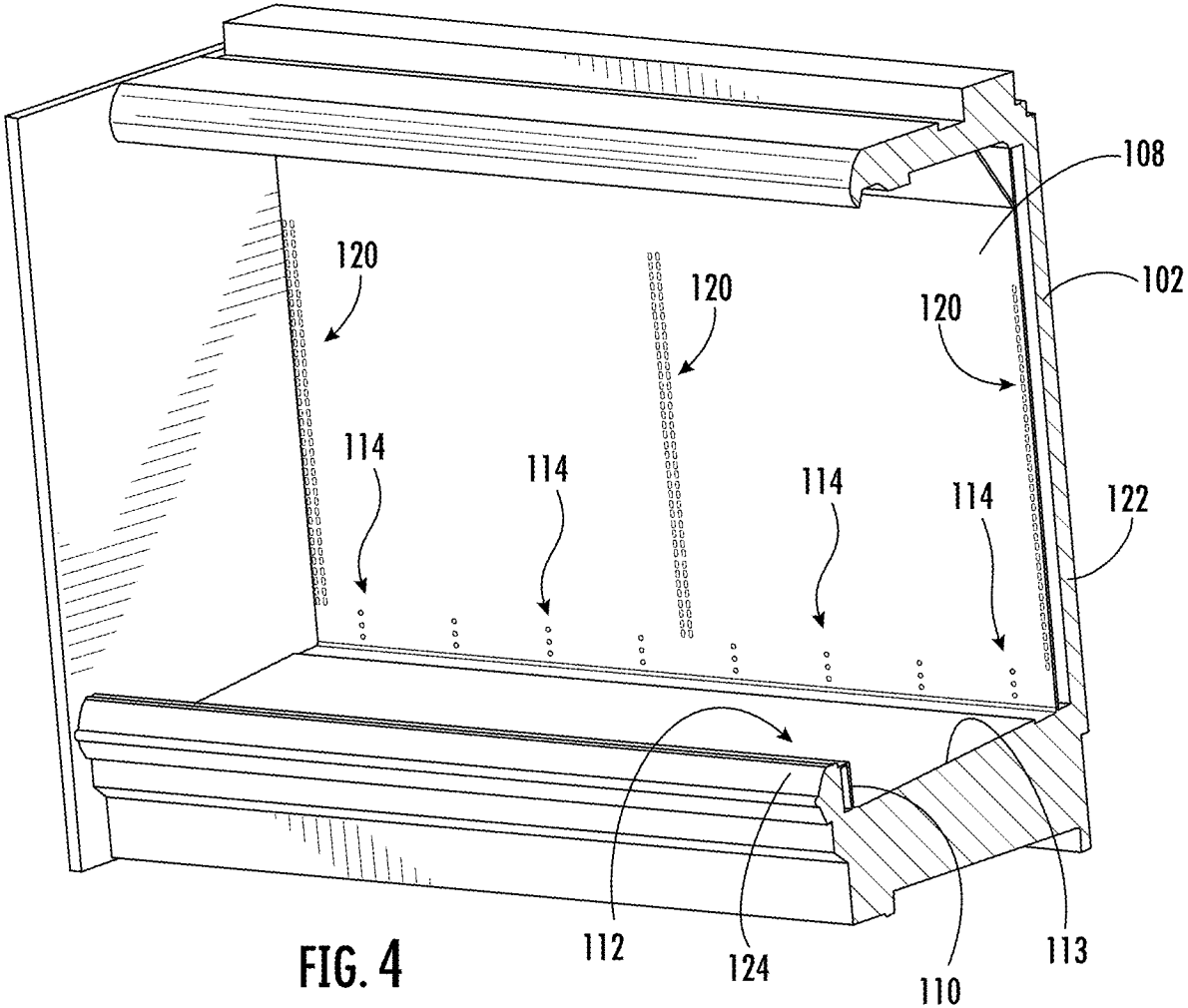
FIG. 4 is cross-sectional and perspective illustration of the shelving frame of the shelving system of FIG. 1.
Figure 5:
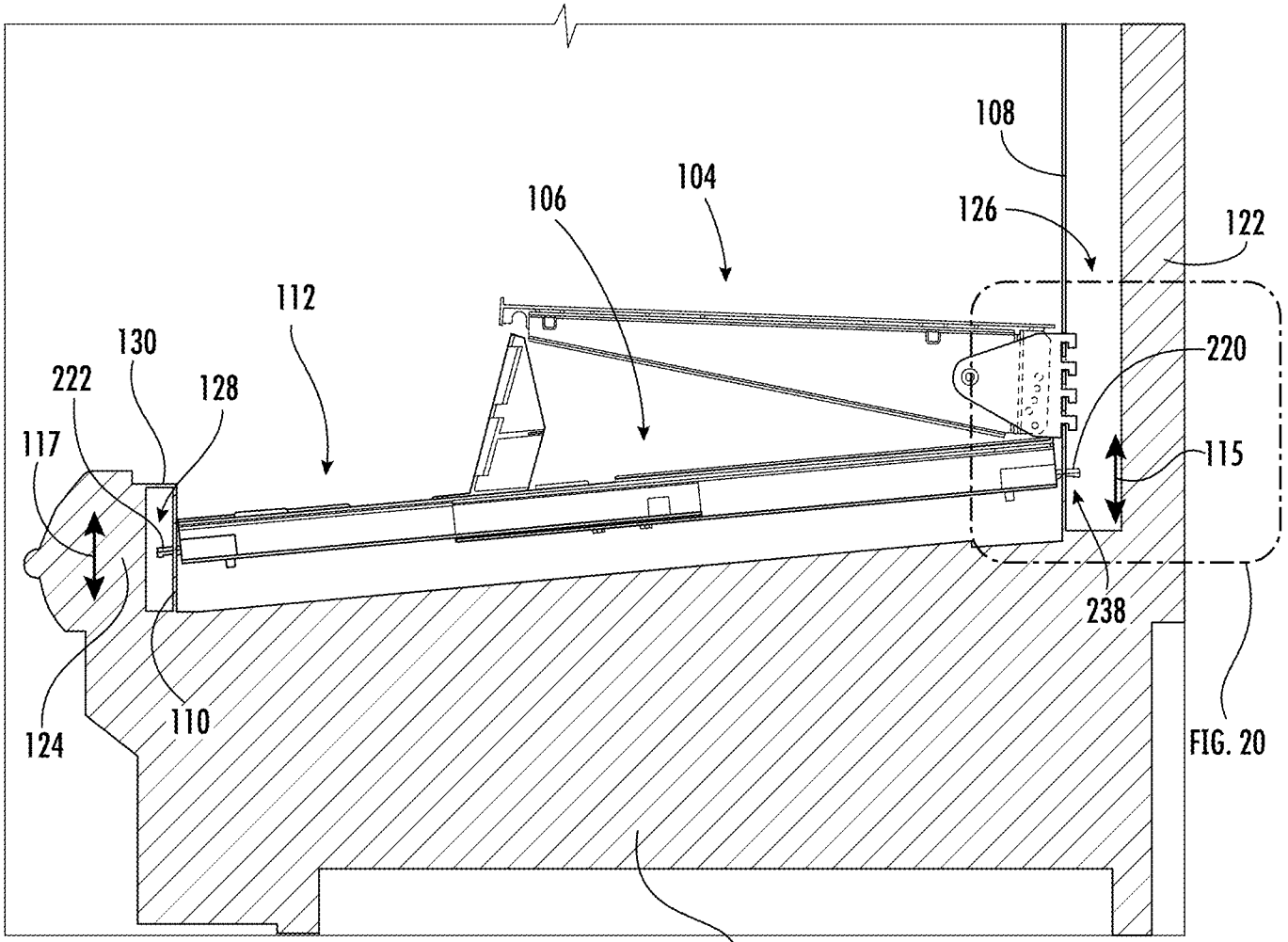
FIG. 5 is a partial cross-sectional illustration of the shelving system of FIG. 1.

With reference to FIGS. 3 and 5, the adjustable rack systems 106 are mountable within selective ones of the rack mounting apertures 114, 116 to adjust the vertical position and angled orientation of the adjustable rack system 106 within the shelving frame 102. For example, the maximum angle can be provided by mounting the adjustable rack system 106 to the upper most mounting apertures 114 in the rear mounting wall 108 and to the lower most mounting apertures 116 in the front mounting wall 110. Further, the maximum height can be provided by mounting the adjustable rack system 106 to the upper most mounting apertures 114, 116 or the lower most height can be provided by mounting the adjustable rack system 106 to the lower most mounting apertures 114, 116. Vertical adjustability of the front and rear edges of the adjustable rack system 106 is represented by arrows 115, 117 in FIGS. 3 and 5.

In addition to mounting apertures 114 for mounting the adjustable rack systems 106, the rear mounting wall 108 includes a plurality of vertically spaced apart shelf mounting apertures 120. Mounting features, such as hooks, of the shelf arrangements 104 are used to selectively mount the shelf arrangements 104 at desired heights using the shelf mounting apertures 120. While only a single shelf arrangement 104 is illustrated in FIG. 1, multiple vertically spaced apart shelf arrangements 104 can be provided.

In this example, the shelving frame 102 includes outer most rear and front walls 122, 124. The rear and front mounting walls 108, 110 are inward of these outer most walls 122, 124. Air cavity 126 is formed between the rear mounting wall 108 and the rear outer most wall 122 and air cavity 128 is formed between the front most mounting wall 110 and the front outer most wall 124.

Further, in some embodiments, the rear mounting wall 108 may be formed from a plurality of components. For example, rear mounting wall 108 could include a plurality of vertical upright members that provides the shelf mounting apertures 120. One or more wall panels could be mounted between the vertical upright members and provide the mounting apertures 114 for mounting the adjustable rack systems 106. Alternatively, all of the mounting apertures 114, 120 could be formed in a single panel that provides the rear mounting wall 108.

As illustrated in FIG. 2, the rear mounting wall 108 extends vertically a first height H1, while the front mounting 110 wall extends vertically a second height H2. The height H2 of the front mounting wall 110 is less than the height H1 of the rear mounting wall. Again, the front and rear mounting walls 110, 108 are spaced apart from one another and the bottom 113 is below a top end 130 of the front mounting wall 110 forming well 112.

When assembled, the shelf arrangements 104 are typically located vertically above the top end 130 of the front mounting wall 110 and vertically above the adjustable rack system 106.

The adjustable rack system 106 extends between a rear edge 132 and a front edge 134. In this example, the adjustable rack system 106 is mounted within the well 112 such that, at least, the front edge 134 is positioned vertically at or below the top end 130 of the front mounting wall 110 of the shelving frame 102.

Typically, the adjustable rack system 106 will extend forward of the front edge of the shelf arrangements 104. More particularly, the shelf arrangements 104 will extend forward of the rear mounting wall 108 a shorter distance than the amount that the adjustable rack system 106 will extend forward of the rear mounting wall 108. As illustrated in FIG. 1, accessories such as false rear walls 135 may be provided that extend within the vertical gap formed between the bottom of the shelf arrangement 104 and the top of the adjustable rack system 106. The false rear walls 135 may be movable forward and backward relative to the adjustable rack system depending on the amount of product to be displayed in front of the false rear walls 135. Further yet, dividers 137 may be provided that are mounted to the adjustable rack system 106 to provide distinct storage regions above the adjustable rack system 106.

In the illustrated shelving system 100 of FIG. 1, product can be stored within the well 112 on the adjustable rack system 106. Typically, product will be stored on the front panel 174, but could be stored on the rear panel 172 as well. The apertures in the front panel 174 assist in vertical air flow through the adjustable rack system 106.

Figure 6:
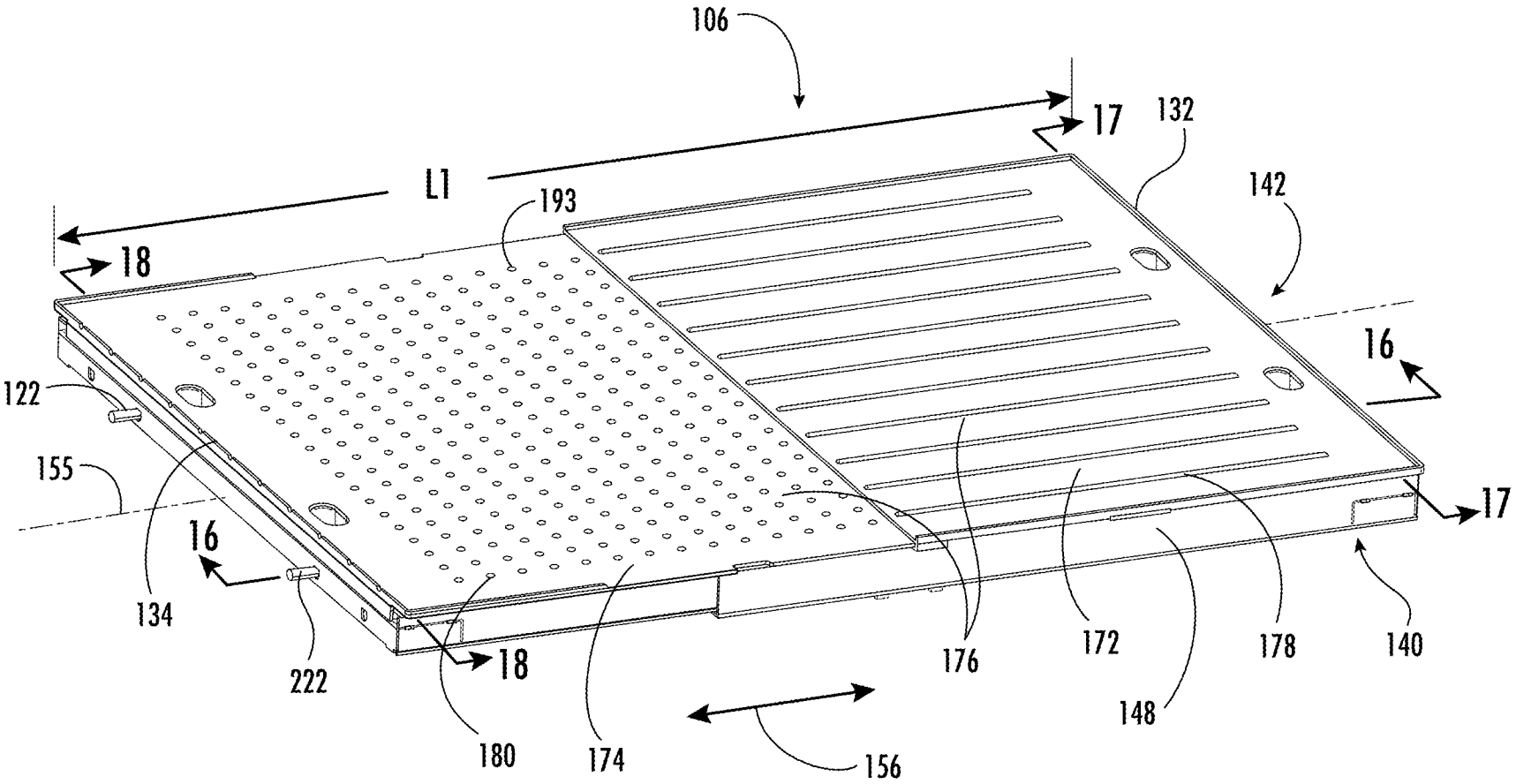
FIG. 6 is a perspective illustration of an adjustable rack system of the shelving system of FIG. 1.
Figure 7:
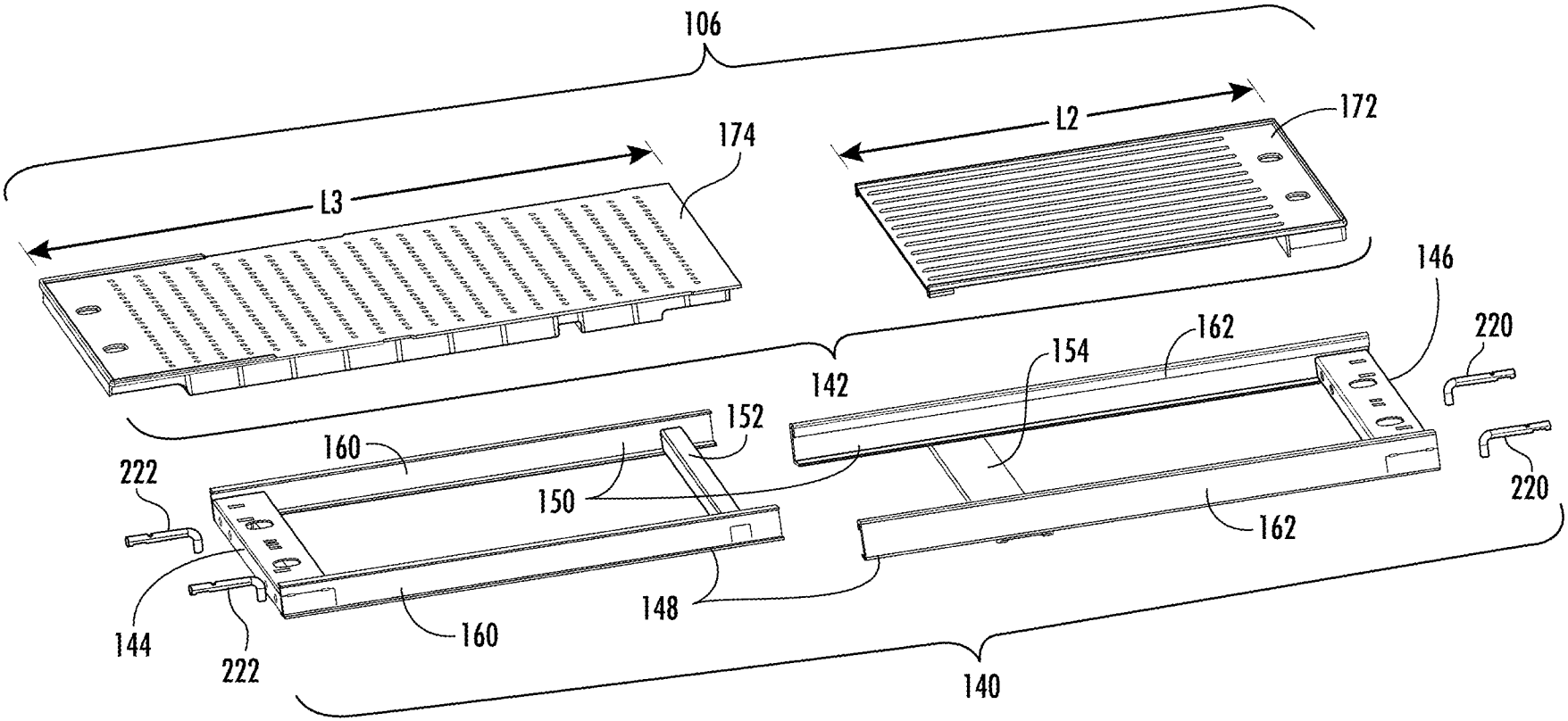
FIG. 7 is an exploded illustration of the adjustable rack system of FIG. 6.

With additional reference to FIGS. 6 and 7, the adjustable rack system 106 includes an adjustable frame 140 and an adjustable rack 142 removably attached to the adjustable frame 140.

With principle reference to FIG. 7, the adjustable frame 140 includes a front rail 144, a rear rail 146, a pair of adjustable longitudinal rails in the form of first side rail 148 and a second side rail 150. The adjustable frame 140, in this example, also includes a pair of intermediate rails 152, 154. The first and second side rails 148, 150 interconnect the front and rear rails 144, 146 while the front and rear rails 144, 146 maintain the lateral spacing between the first and second side rails 148, 150.

The length L1 of the adjustable rack system 106 and spacing between the rear and front edges 132, 134 is adjustable along adjustment axis 155, as illustrated by arrow 156. This allows the adjustable rack system 106 to be used in different shelving frames (e.g. where the rear and front mounting walls 108, 110 are closer or farther apart than in the illustrated example). Further, this allows for adjustment in the length L1 of the adjustable rack system 106 depending on the necessary length when adjusting the angle of the adjustable rack system 106 within a given shelving frame 102.

To allow for adjusting the length L1 of the adjustable rack system 106, both the adjustable frame 140 and the adjustable rack 142 are likewise lengthwise adjustable.

To permit for adjusting the length of the adjustable frame 140, the first and second side rails 148, 150 are lengthwise adjustable. Adjusting the length of the first and second side rails 148, 150 adjusts the spacing between the front and rear rails 144, 146 along the adjustment axis 155. While a pair of side rails 148, 150 are illustrated, other examples may include more or less longitudinally adjustable rails. For instance, a single central rail extending generally parallel to the adjustment axis could be included.

Each of the first and second side rails 148, 150 includes a front side rail member 160 and a rear side rail member 162. For each side rail 148, 150, the front side rail member 160 is slidably engaged with the rear side rail member 162 such that the front side rail member 160 is adjustably positionable relative to the rear side rail member 162 to adjust the length of the corresponding side rail 148, 150. The front rail 144 interconnects the two front side rail members 160. The rear rail 146 interconnects the two rear side rail members 162.

As such, the front rail 144 and two front side rail members 160 form a first unit that defines a front portion of the adjustable frame that moves relative to a second unit formed by the rear rail 146 and two rear side rail members 162 that defines a rear portion of the adjustable frame.

In this example, the two front side rail members 160 slide into and between the two rear side rail members. In one example, (with reference to FIG. 8) each rear side rail member 162 forms one or more channels 164 between inner and outer walls 166, 168 that receive the corresponding front side rail member 160. The inner and outer walls 166, 168 are connected by a top wall 170.

The adjustable rack 142 is formed by a plurality of interconnected panels that can slide relative to one another along the adjustment axis 155 so as to allow for adjusting the length of the adjustable rack 142 as well as spacing between rear and front edges 132, 134. In this example, the adjustable rack 142 includes a first panel 172 and a second panel 174. The first panel 172 is a rear most panel and the second panel 174 is the front most panel. The first panel 172 defines rear edge 132 while the second panel 174 defines front edge 134. The first and second panels 172, 174 are interconnected such that they are adjustably positional The first panel 172 extends over a rear most portion of the second panel 174.

The first and second panels 172, 174 combine to form a top surface 176 that is formed in part by each of the first and second panels 172, 174.

In this example, the top surface 176 includes a plurality of upward extending ribs 178 as well as a plurality of apertures 180. In this example, first panel 172 includes the ribs 178 while the second panel 174 includes apertures 180. In this example, the ribs 178 are generally parallel to side rails 148, 150 and adjustment axis 155. Further, the apertures 180 extend entirely through second panel 174.

The two side edges and rear edge of the first panel 172, in this example are raised, but need not be in other examples. Further, the front edge and portions of the two side edges of the second panel 174 are raised in this example.

The length L2 of the first panel 172 is shorter than the length L3 of the second panel 174.

With reference to FIGS. 8-11, the first and second panels 172, 174 are coupled by a sliding interlock 180 therebetween. The sliding interlock permits the first and second panels 172, 174 to slide relative to one another along the adjustment axis 155 but prevents the first and second panels from being disconnected from one another along an axis generally orthogonal to the top surface of the adjustable rack 142.

The sliding interlock 180 includes first and second clips 182 provided by the first panel 172 and a pair of slide regions 184 provided by the second panel 174. The slide regions 184 are slidingly received in channels 186 formed by the clips 182.

The clips 182, in this example, are unitarily formed with the rest of the first panel 172 as a single continuous piece of material.

Each clip 182 includes a leg portion 188 that extends downward from a main panel 190 of first panel 172. A foot portion 192 extends laterally, inward in this example, from the leg portion 188. The gap between the bottom of main panel 190 and a top surface of foot 192 forms the channel 186. The foot 192 thus forms an undercut region. The foot 192 and main panel 190 bound slide region 184 to prevent disengagement in a direction orthogonal to the top surface of the adjustable rack 142 while allowing sliding motion parallel to adjustment axis 155.

In this example, the slide regions 184 are formed as part of edges defining the outer most periphery of the second panel 174. However, in other embodiments, the slide regions could be inboard of the outer most periphery and could be provided by slots formed in the second panel 174. In such an arrangement In this example, the feet 192 of the pair of clips 182 extend toward one another in this example. The slide regions 184 are thus located laterally between the pair of legs 188 of the pair of clips 182.

An abutment stop 194 is provided at one end of the slide regions 184 to limit axial sliding motion of the sliding interlock and to prevent unexpected disconnect of the first and second panels 172, 174 when adjusting the axial length of the adjustable rack 142. If the user attempts to over extend the adjustable rack 142, an end clip 182 will abut stop 194 limiting relative motion between the panels 172, 174.

At an opposite end of each slide region 184 a notch 196 is provided in main panel 193 of the second panel 174. The notches 196 allow for assembly of the adjustable rack 142 and particularly for passage of the feet 192 past the slide regions 184. Thus, the notches 196 are sized and configured to permit the feet 192 to pass therethrough. However, in other examples, the clips 182 may be sufficiently flexible that they clips can flex to allow for attachment of the clip 182 to the slide regions 184.

In this example, the surface area of the main panels 190, 193 has less than 50% being apertures and in preferred embodiments less than 30% and even more preferably less than 25%. This reduces the difficulties in cleaning the panels 172, 174 as compared to wire racks.

Figure 10:
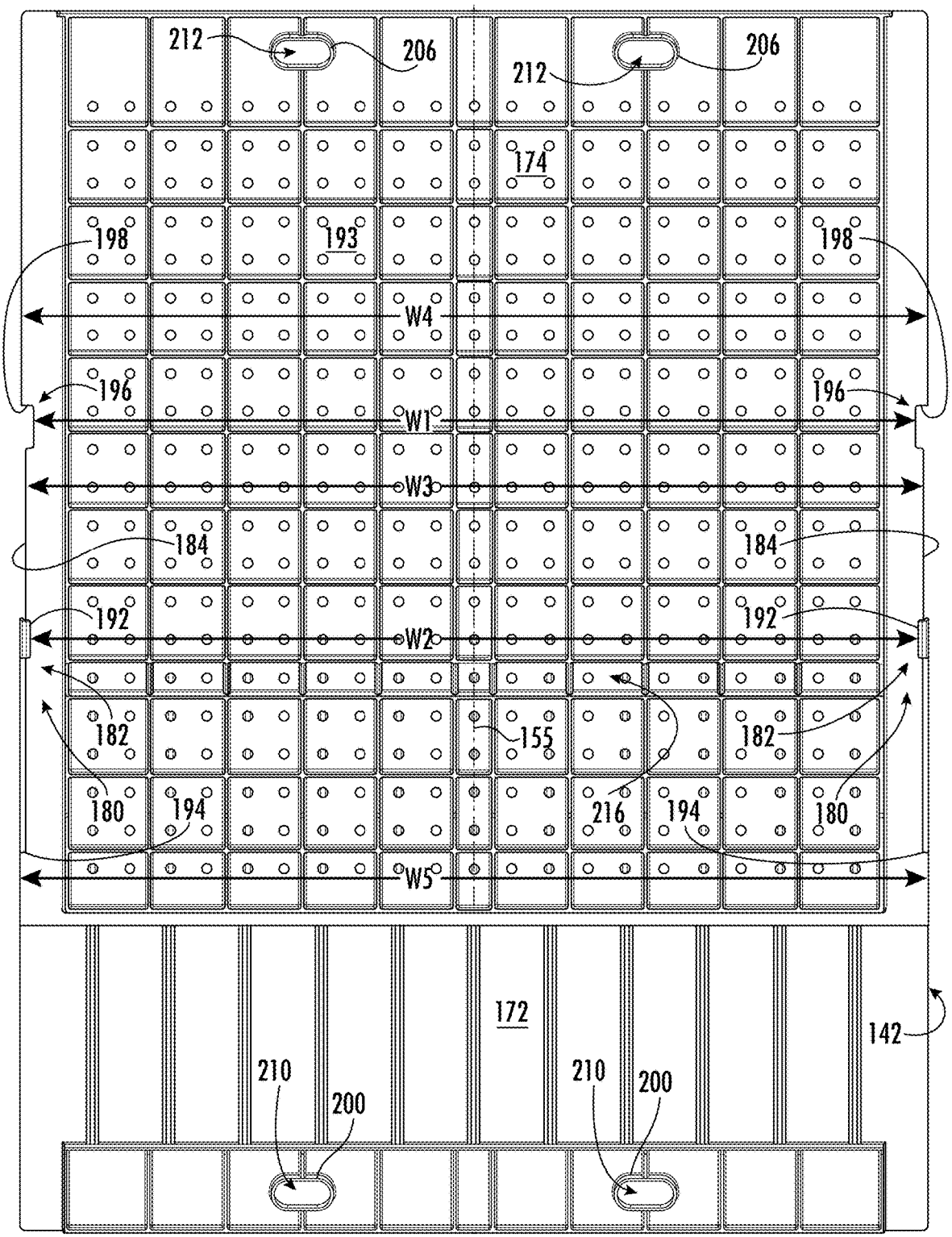
FIG. 10 is a bottom view illustration of the adjustable rack of the adjustable rack system of FIG. 6.
Figure 11:
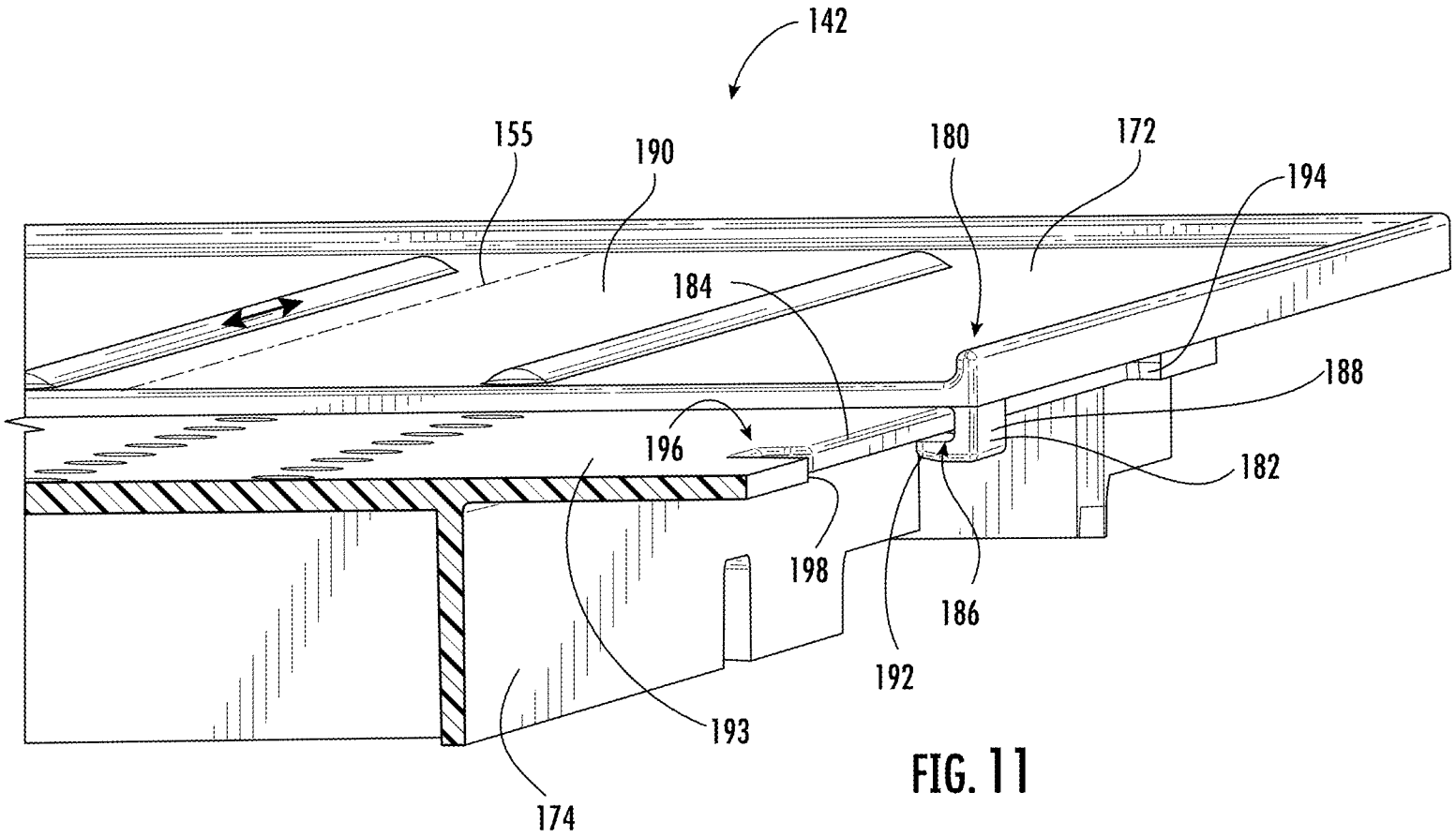
FIG. 11 is an enlarged perspective illustration of the adjustable rack of the adjustable rack system of FIG. 6 illustrating a portion of the sliding interlock between the panels of the adjustable rack.
Figure 12:
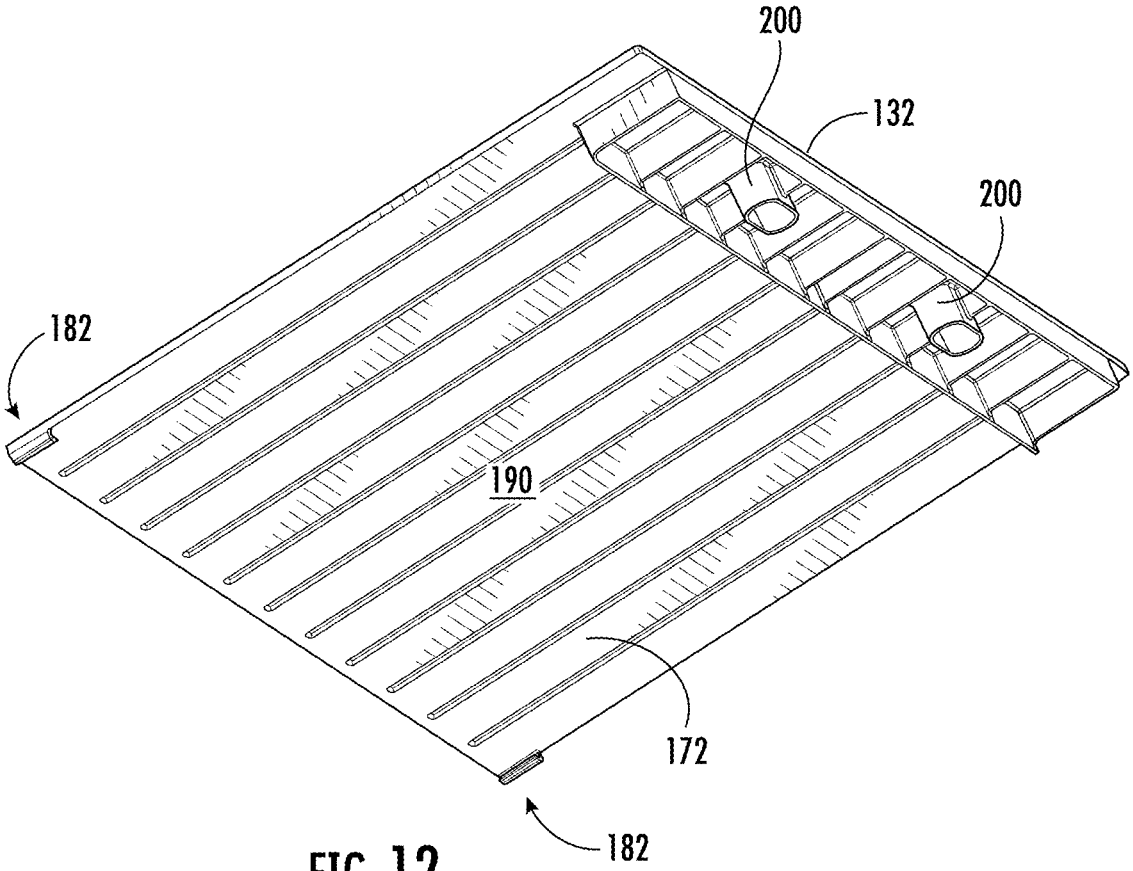
FIG. 12 is a bottom perspective illustration of a first panel of the adjustable rack of the adjustable rack system of FIG. 6.
Figure 13:
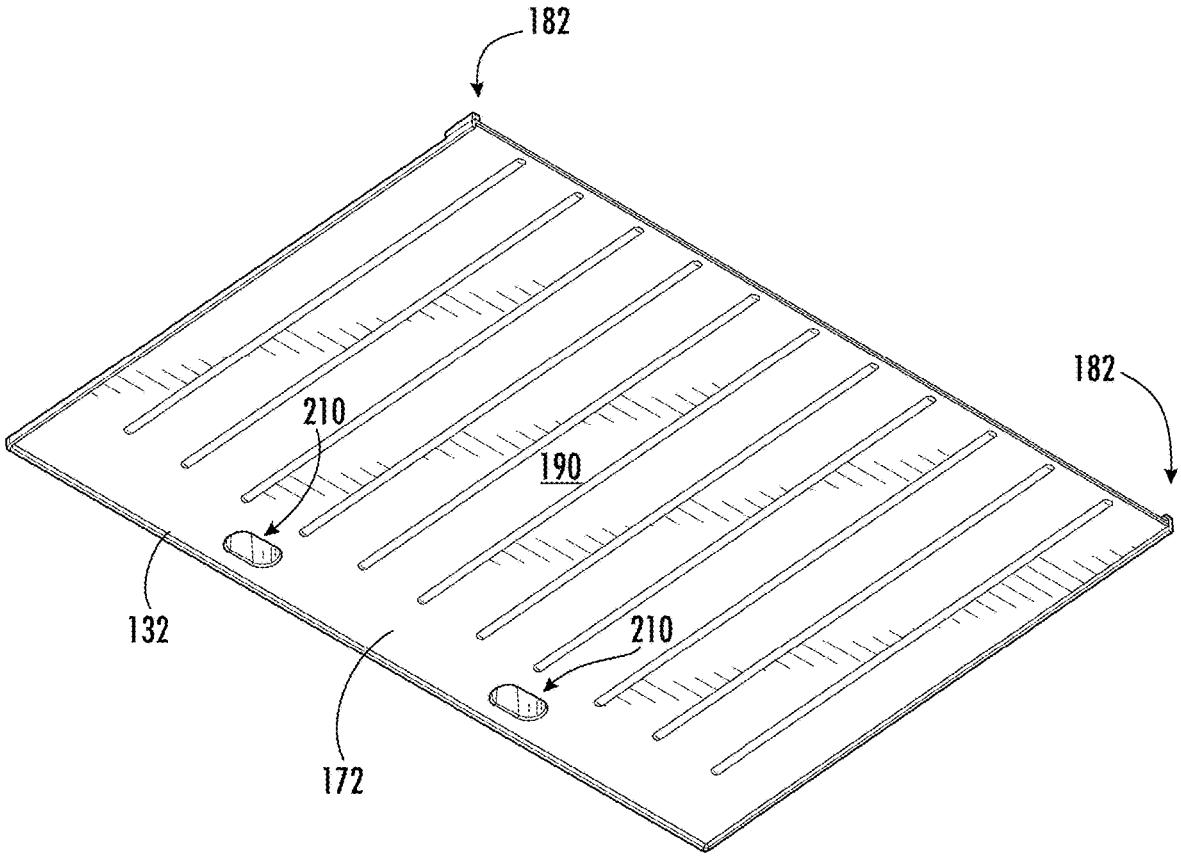
FIG. 13 is a top perspective illustration of a first panel of the adjustable rack of the adjustable rack system of FIG. 6.
Figure 14:
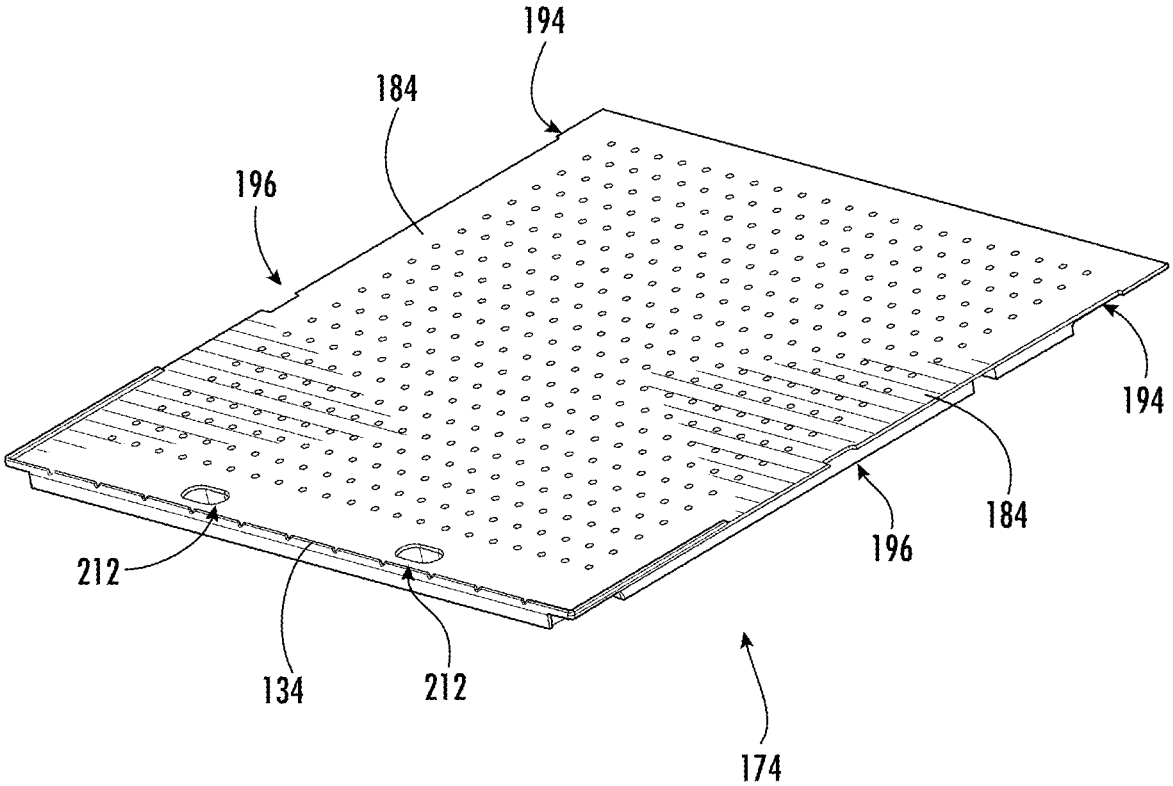
FIG. 14 is a top perspective illustration of a second panel of the adjustable rack of the adjustable rack system of FIG. 6.
Figure 15:
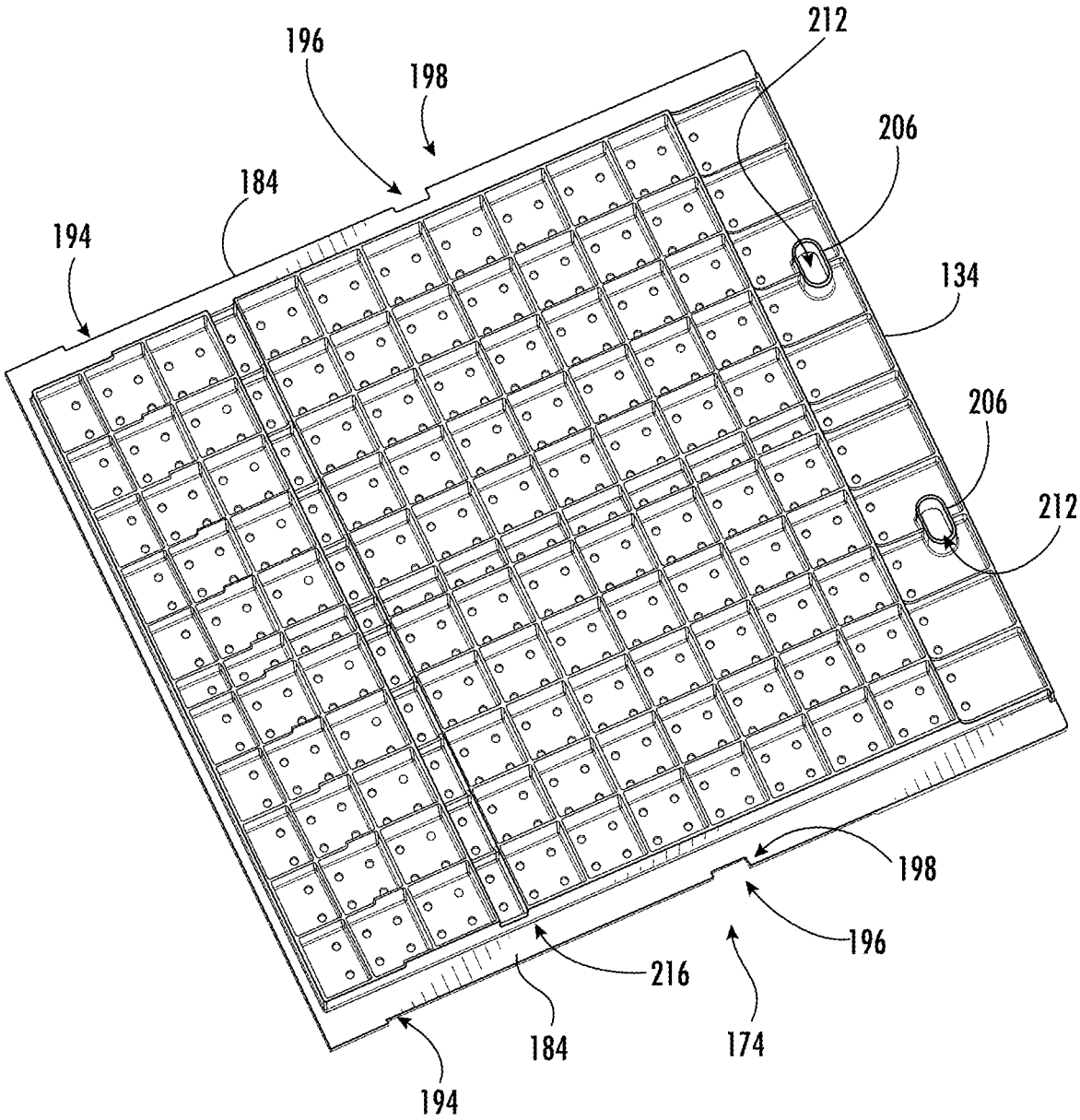
FIG. 15 is a bottom perspective illustration of a second panel of the adjustable rack of the adjustable rack system of FIG. 6.

With reference to FIG. 10, a width W1 between the inner most edge of the notches 196 is less than the width W2 between the inner most edges of the feet 192. Similarly, the width W3 between the outer most portion of slide regions 184 is greater than the width W2 between the inner most edges of the feet 192.

In this example, at the end of each notch 196, opposite slide regions 184, is an abutment 198 that assists in quickly aligning the clips 182 with the notches 196 when disassembling the adjustable rack 142. The width W4 provided by the abutments 198 is greater than width W1 and width W3 so that the clips 182 will abut the abutments 198. The width W5 of abutments 194 is greater than width W3.

While discussed as having the clips 182 be part of the first panel 172 and the slide regions 184 be part of the second panel 174, it is contemplated that the features could be switched such that the clips 182 are part of second panel 174 and the slide regions 184 are part of the first panel 172.

In other embodiments, the notches 196 could be formed in between portions of a slide region 184 such that portions of the slide region straddle the notches 196.

FIGS. 12-15 are further illustrations of the first and second panel 172, 174.

Figure 16:
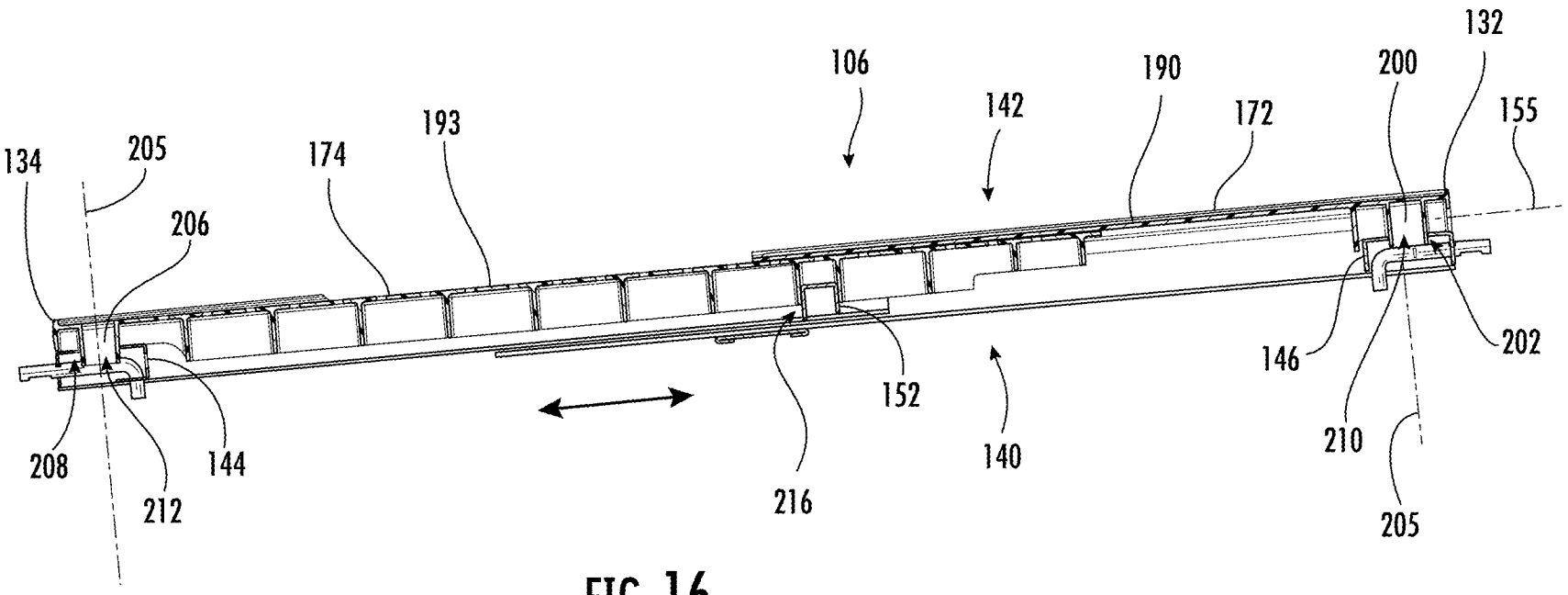
FIG. 16 is a cross-sectional illustration of the adjustable rack system of FIG. 6 taken about line 16-16 in FIG. 6.
Figure 17:
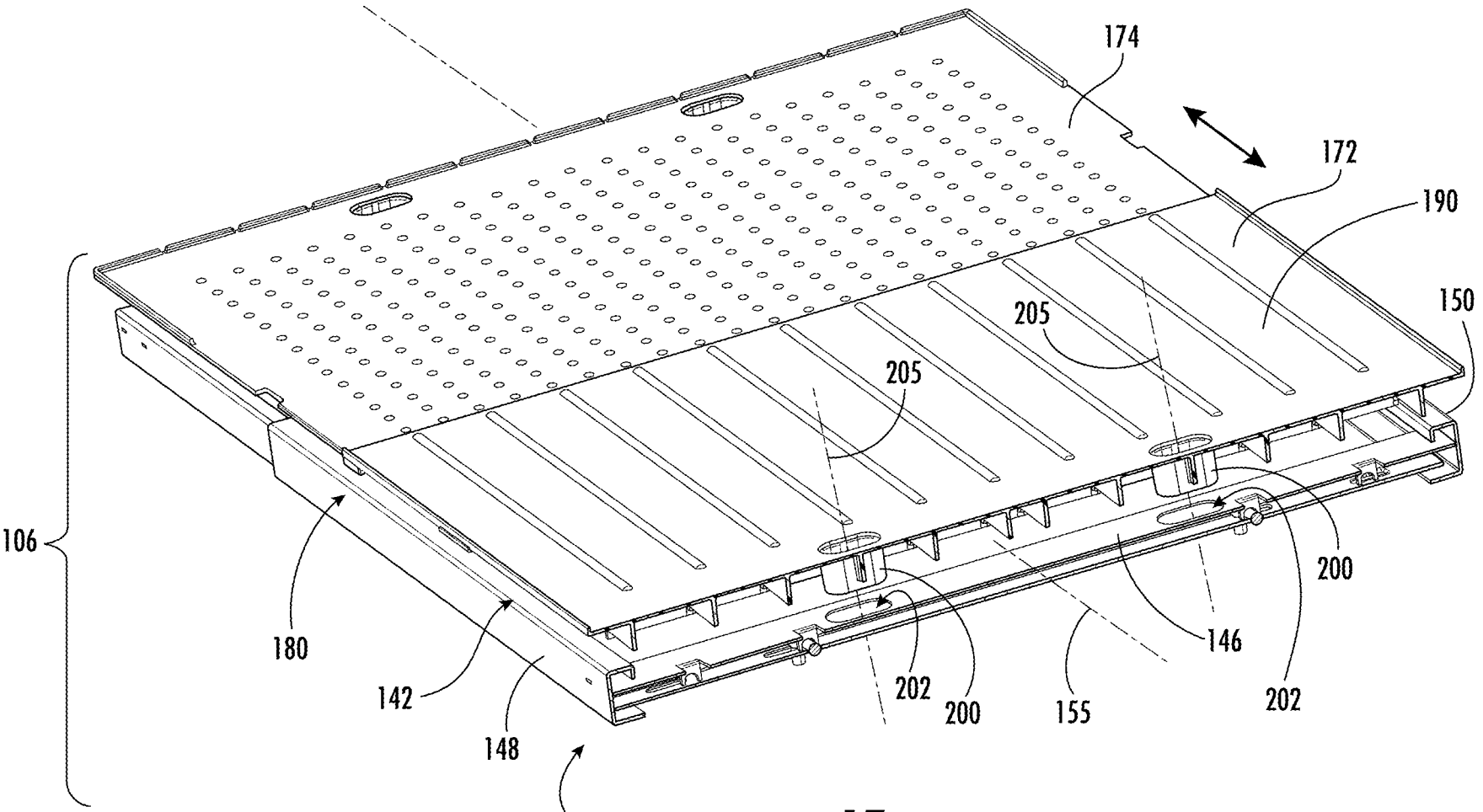
FIG. 17 is a cross-sectional illustration of the adjustable rack system of FIG. 6 taken about line 17-17 in FIG. 6 taken through the rear rail.
Figure 18:
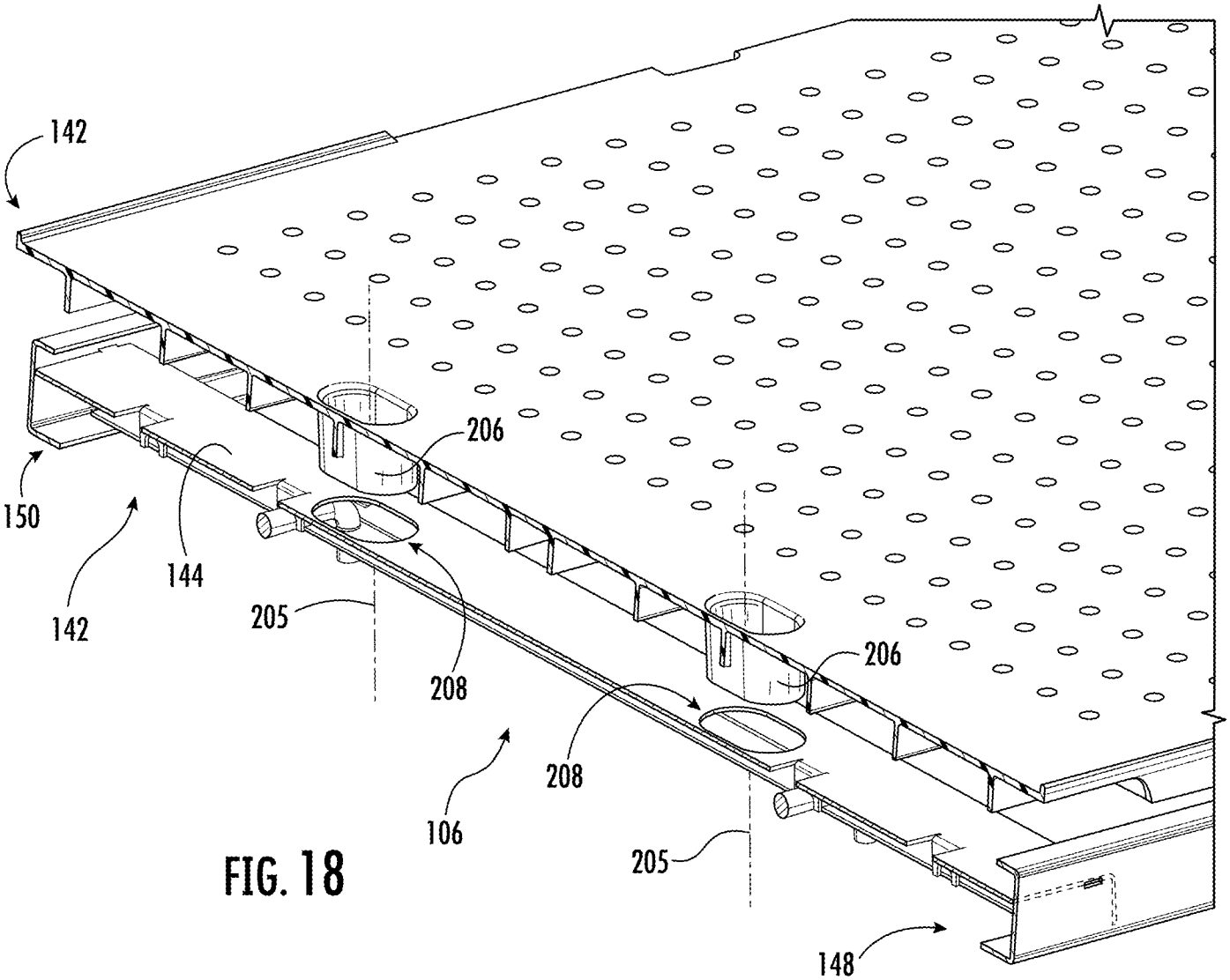
FIG. 18 is a cross-sectional illustration of the adjustable rack system of FIG. 6 taken about line 18-18 in FIG. 6 taken through the front rail.

With reference to FIGS. 16-18, the adjustable rack 142 is removably attached to the adjustable frame 140. The first panel 172 is operably attached to the rear rail 146 such that the first panel 172 and rear rail 146 move as a unit together relative to the front rail 144 and second panel 174 along the adjustment axis 155. This allows for adjusting a length of the adjustable rack system 106.

The adjustable rack 142 may be removed from the adjustable frame 140 simultaneously as a single unit.

To removably attach the adjustable rack 142 to the adjustable frame 140, the first panel 172 includes a plurality of mounting projections 200 that extend downward from main panel 190 and below the top surface defined by the adjustable rack 142. The mounting projections 200 extend into corresponding mounting apertures 202 formed in the rear rail 146. The interaction between the mounting projections 200 and mounting apertures 202 fixes the first panel 172 relative to the rear rail 146 along the adjustment axis 155 such that the two components move together and prevent movement therebetween along the adjustment axis 155. However, by being axially inserted into the apertures 202, the first panel 172 can be disconnected from the rear rail 146 along an axis 205 perpendicular to the top surface and main panel 190.

Similarly, the second panel 174 includes a plurality of mounting projections 206 that extend downward from main panel 193 and below the top surface defined by the adjustable rack 142. The mounting projections 206 extend axially into corresponding mounting apertures 208 formed in the front rail 144. The interaction between the mounting projections 206 and the mounting apertures 208 fixes the second panel 174 to the front rail 144 along the adjustment axis 155 such that the two components move together and prevent movement therebetween along the adjustment axis 155. However, by having the projections 206 axially inserted into the apertures 208, the second panel 174 can be disconnected from the front rail 144 along axis 205 perpendicular to the top surface and main panel 190.

In this example, the mounting projections 200, 206 are formed by annular walls that extend axially downward from main panels 190, 193, respectively. The annular walls forming the mounting projections 200, 206 define apertures 210, 212 that extend through the mounting projections 200, 206. The apertures 210, 212 extend through the top surface of the panels 172, 174 and the top surface of the adjustable rack 142. The apertures 210, 212 are sized and configured for receipt of a user's finger or fingers to allow a user to grasp the first and second panels 172, 174 to remove the adjustable rack 142 axially upward from adjustable frame 140.

While the mounting apertures 202, 208 are illustrated as being formed in the front and rear rails 144, 146, in other embodiments, the front and rear mounting apertures 202, 208 could be formed in the front and/or rear side rail members 160, 162 rather than in the front and rear rails 144, 146. In such an arrangement, the panels 172, 174 would be operably connected to the front and rear rails 144, 146, albeit indirectly by way of the front and rear side rail members 160, 162.

Figure 8:
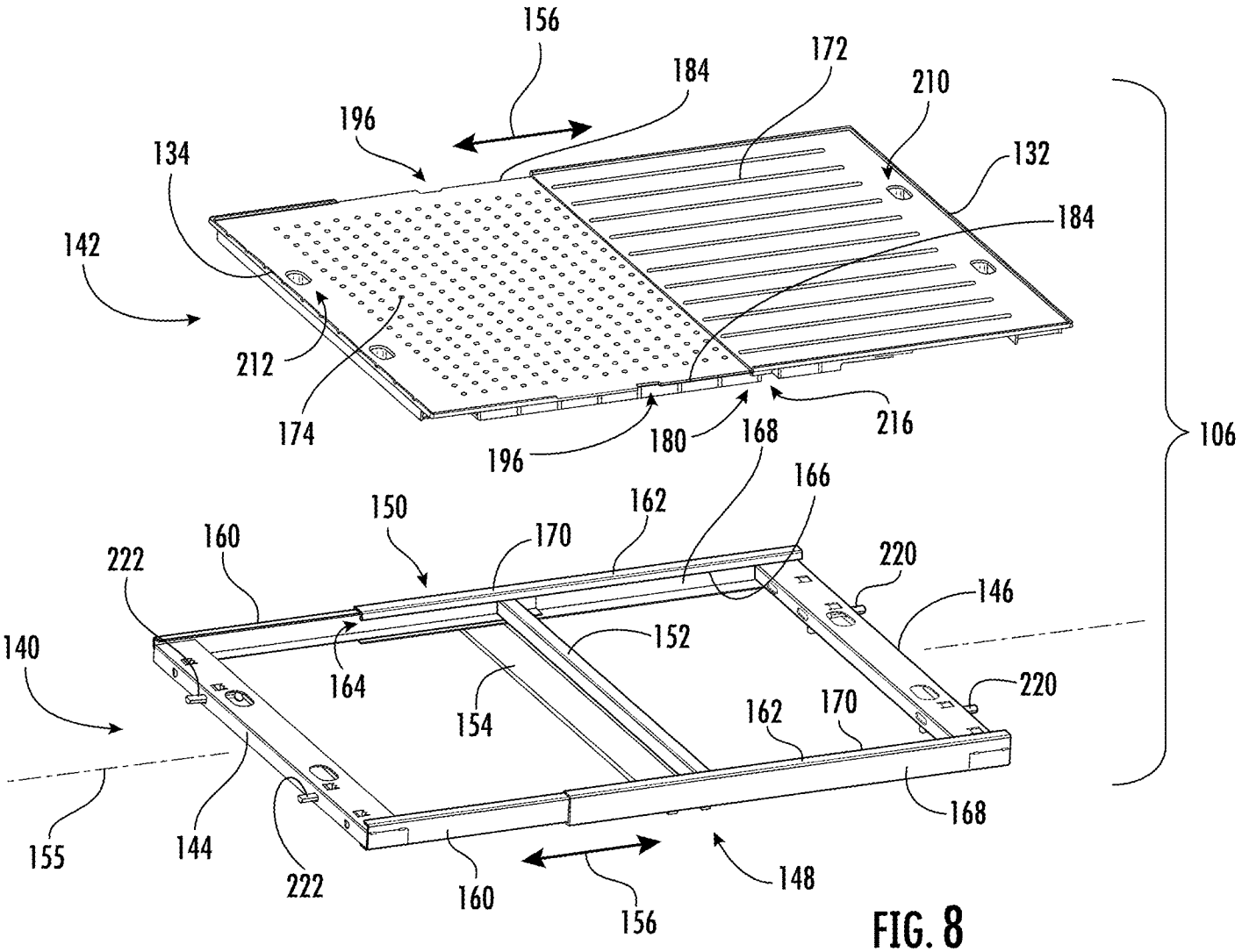
FIG. 8 is a partial exploded illustration of adjustable rack system of FIG. 6 having the adjustable rack removed from the adjustable frame.
Figure 9:
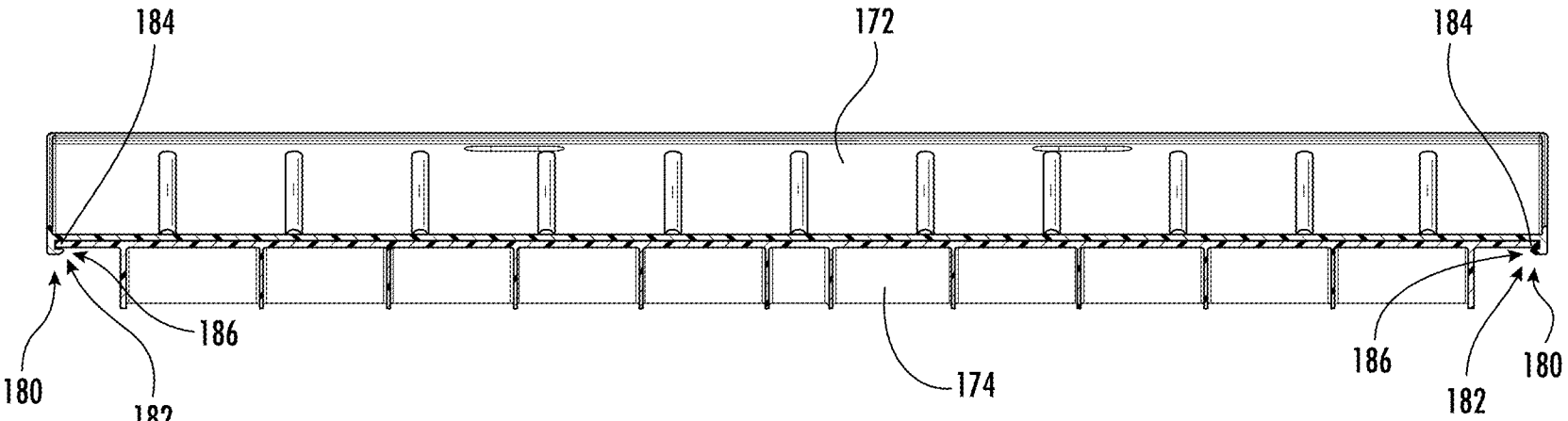
FIG. 9 is a cross-sectional illustration of the adjustable rack of the adjustable rack system of FIG. 6.

With reference to FIGS. 8, 10 and 16, the adjustable frame 140 includes intermediate rail 152 that extends laterally between the first and second side rails 148, 150 and particularly the front side rail members 160 thereof. The second panel 174 includes a channel 216 that axially receives the intermediate rail 152. The channel 216 further axially fixes the second panel 174 relative to front rail 144. The channel 216 is formed in an underside of second panel 174.

The intermediate rail 152 also vertically supports the inner portion (e.g. portion opposite front edge 134) of the second panel 174.

With reference to FIGS. 3 and 5-7, the adjustable rack system, and particularly adjustable frame 140 thereof, is removably mountable to the shelving frame 102 and particularly the rear and front mounting walls 108, 110 as noted previously.

Rear and front frame mounts 220, 222 mount the adjustable frame 140 to the shelving frame 102. The rear and front frame mounts 220, 222 are identical in the illustrated embodiment, except the rear frame mounts 220 are operably attached to the rear rail 146 while the front frame mounts 222 are operably attached to the front rail 144.

Figure 19:
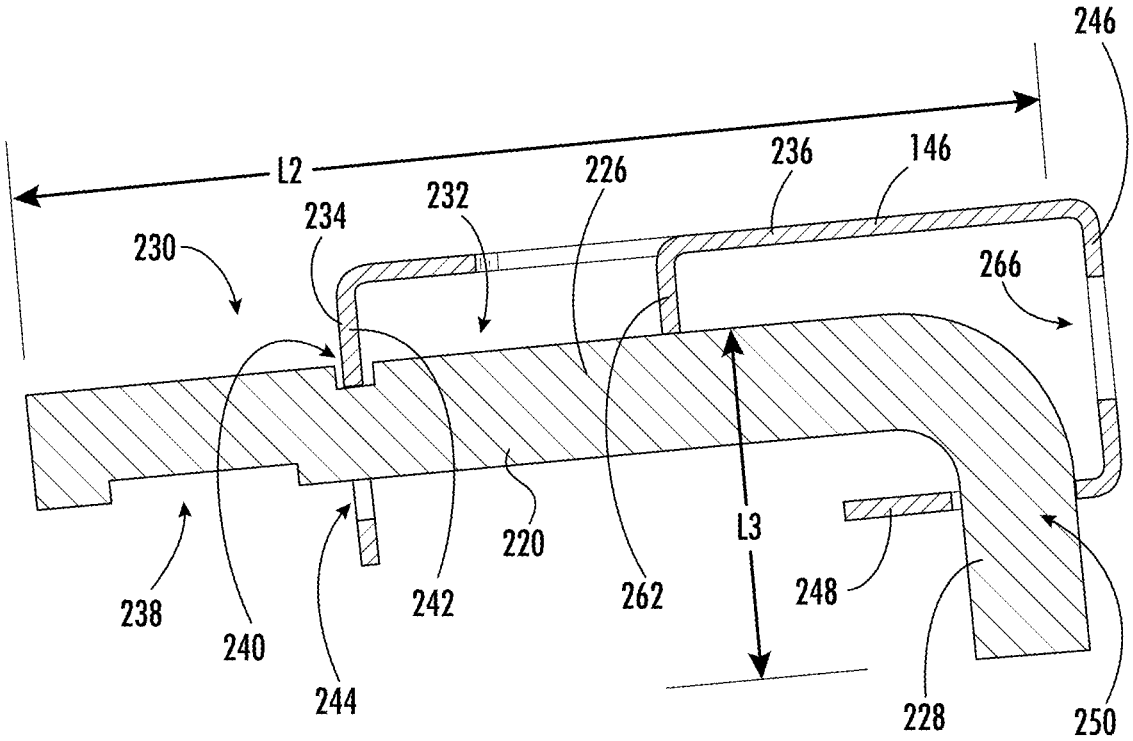
FIG. 19 is a cross-sectional illustration of a laterally extending rail (e.g. rear rail or front rail) and an installed frame mount (e.g. front or rear frame mount)

As illustrated in FIG. 19, a rear frame mount 220 is mounted removably within rear rail 146. Notably, the mounting of the front frame mounts 222 to the front rail 144 is the same.

The rear frame mount 220 in this example includes a first leg 226 and a second leg 228. The first leg 226 has a length L2 that is greater than a length L3 of the second leg 228. The second leg 228 extends from the first leg 226 forming an L-shape. In this example, the rear frame mount 220 is a single continuous piece of material. The rear frame mount 220 can be formed from a bent wire.

When installed, the rear frame mount 220 includes an exposed portion 230 and a mounting portion 232. The exposed portion 230 is external to the rear rail 146. In particular, the exposed portion 230 extends rearward of a rear side 234 of the rear rail 146. The mounting portion 232 is forward of the rear side 234 and located generally below top wall 236 of the rear rail 146. The mounting portion 232 secures the rear frame mount 220, at least in part, to the rear rail 146.

Figure 20:
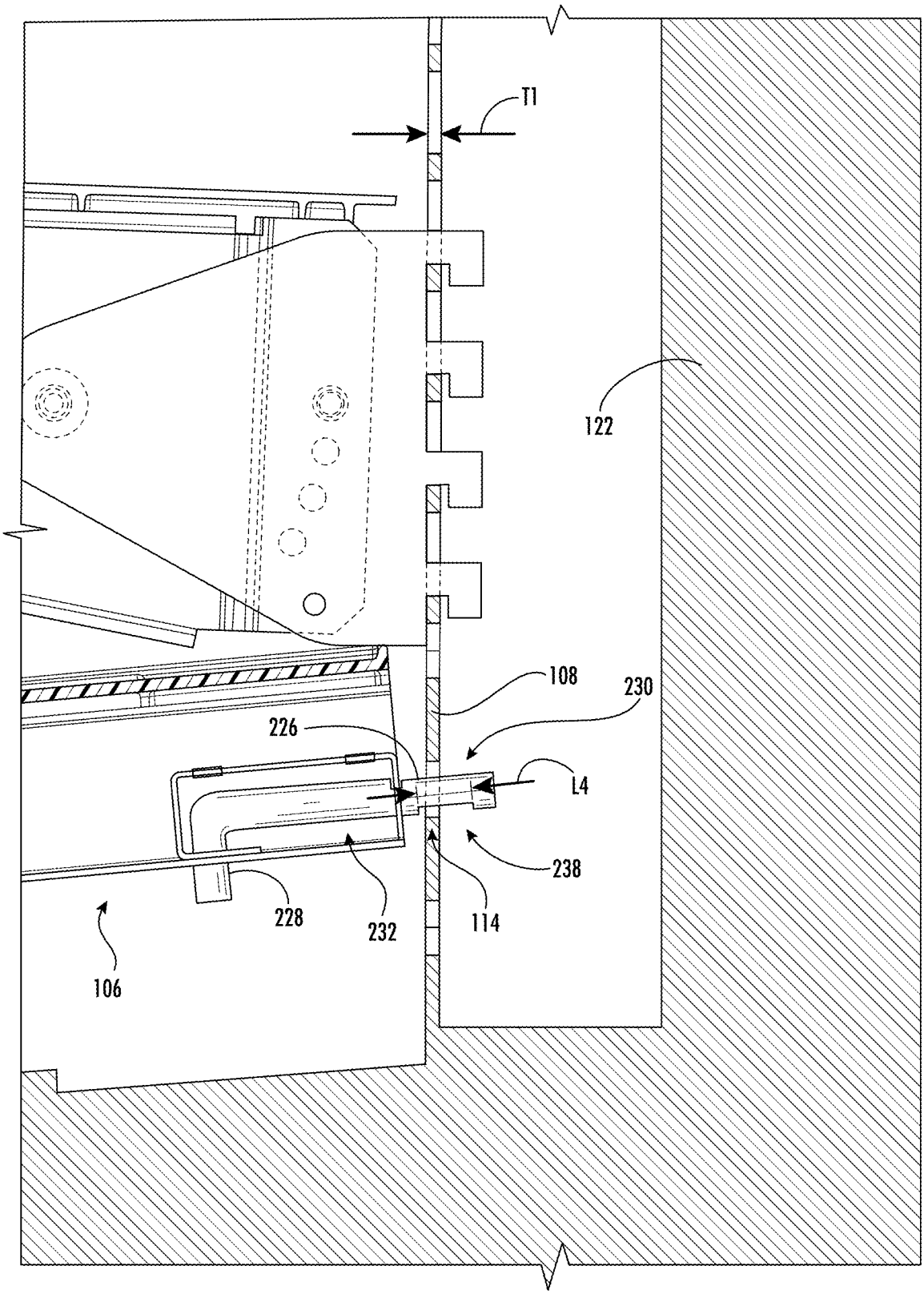
FIG. 20 is a partial cross-sectional illustration of the shelving system of FIG. 1 illustrating the mounting of a shelving arrangement and the adjustable rack to the rear mounting wall of the shelving frame.

The exposed portion 230 of the first leg 226 mates with the rear mounting wall 108 of the shelving frame 102 (see e.g. FIGS. 5 and 20). The exposed portion 230 includes a downward opening notch 238. The exposed portion 230 extends through a selected rack mounting aperture 114 with the downward opening notch 238 engaging the rear mounting wall 108. This helps properly locate and secure the adjustable frame 140 to the rear mounting wall 108. The notch region of the first leg 226 will rest on the portion of the rear mounting wall 108 that forms the bottom portion of mounting aperture 114.

Notably, the length L4 of the notch 238 is sufficiently greater than the thickness T1 of the rear mounting wall 108. This allows for the notch 238 to be more easily installed as well as to accommodate changes in angle of the adjustable rack system 106 as discussed previously. In some examples, Length L4 is at least twice thickness T1, at least three times thickness T1, and more preferably at least four times thickness T1.

As illustrated in FIG. 19, the first leg 226 includes an upward opening notch 240. The upward opening notch 240 receives a portion of a rear wall 242 of the rear rail 146. This portion of the rear wall 242 bounds an opening 244 through which the first leg 226 extends.

The rear rail 146, as noted above, has a top wall 236 and a rear wall 242. The rear rail also includes a front wall 246 and a bottom wall 248. The bottom wall 248 is connected to the top wall 236 by front wall 246. The bottom wall 248 includes a laterally elongated aperture 250 that receives the second leg 228 axially therethrough. One or more of the engagement between notch 240 and rear wall 242 and the engagement of the second leg 228 and the bottom wall 248 axially locates the rear frame mount 220 relative to the rear rail 146.

Notch 238 extends along the first leg 226 a further length than notch 240.

Figure 21:
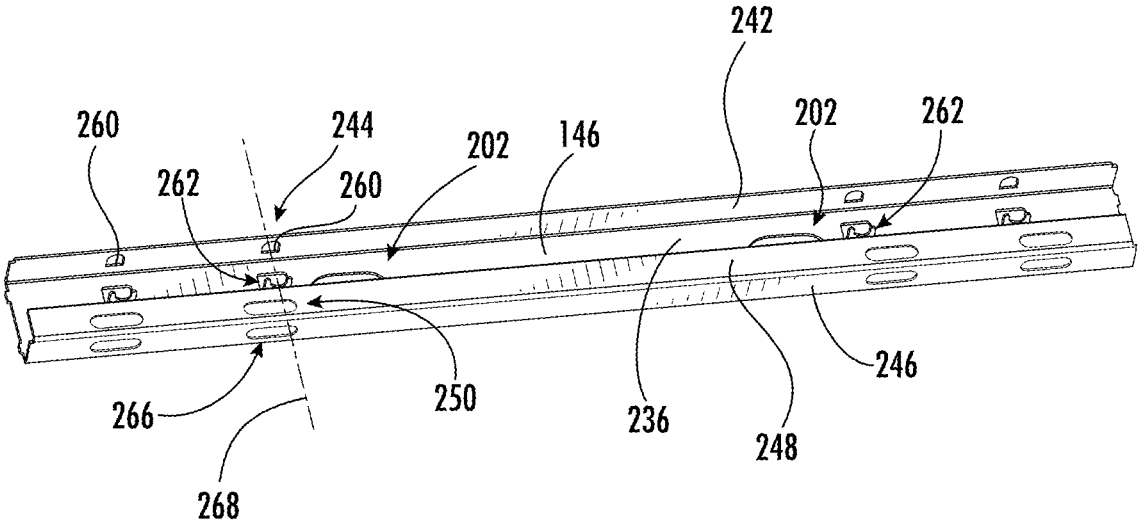
FIG. 21 is a perspective view of a laterally extending rail (e.g. rear rail or front rail)
Figure 22:
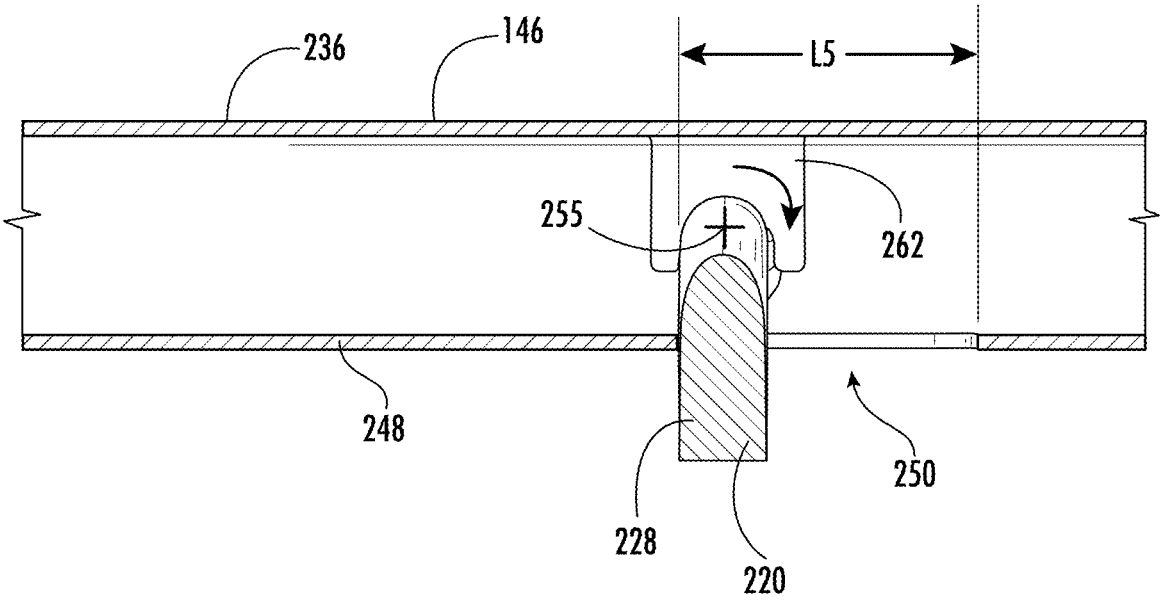
FIG. 22 is a simplified illustration of a later extending rail (e.g. rear rail or front rail) and an installed frame mount (e.g. front or rear frame mount), with the frame mount in the installed position.
Figure 23:
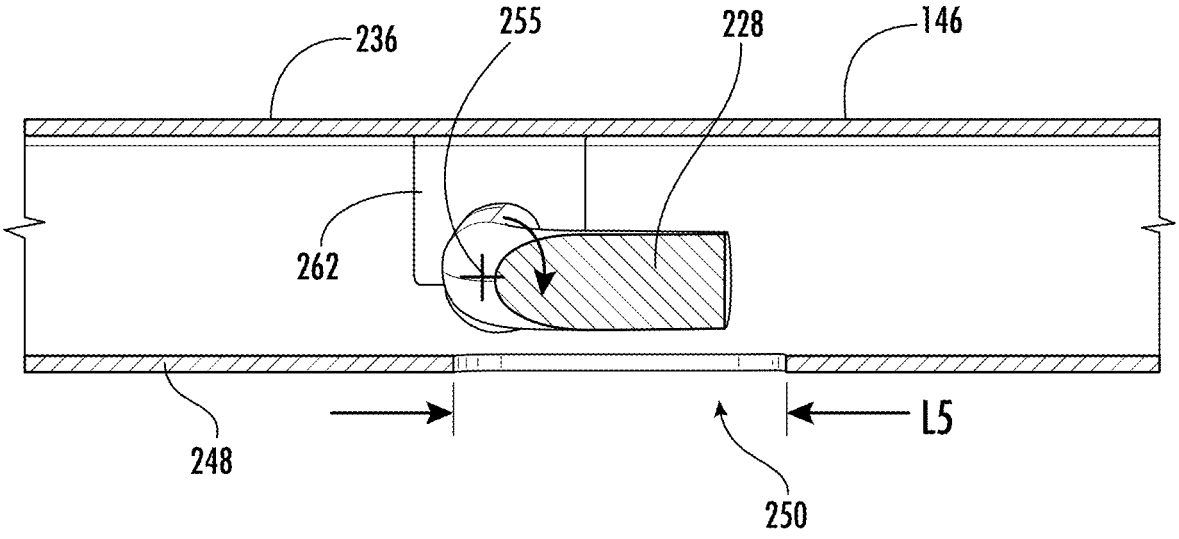
FIG. 23 is a simplified illustration of a later extending rail (e.g. rear rail or front rail) and an installed frame mount (e.g. front or rear frame mount), with the frame mount in a rotated position prior to being fully installed.

FIGS. 21-23 illustrate how aperture 250 is laterally elongated. Notably, the length L5 of aperture 250 is such that the rear frame mount 220 can be rotated about axis 255 from an orientation where second leg 228 is generally horizontal and not extending into aperture 250 (see FIG. 23) to an orientation where second leg 228 is substantially vertical and extends into aperture 250 (see FIG. 22).

Aperture 244, in the illustrated embodiment, is generally D-shaped and has a flat region 260 that is received in upward opening notch 240.

Rear rail 146 further includes a downward opening yoke 262 that includes a cavity that receives the mounting portion 232 of the first leg 226. The yoke 262 extends downward from the top wall 236 and is located between the front and rear walls 246, 242. The yoke 262 is also located between the rear wall 246 and aperture 250 in the bottom wall 250.

Rear rail 146 and particularly front wall 246 may include a further elongated aperture 266 to assist in installation of the rear frame mount 220. This elongated aperture 266 is sized to allow second leg 228 to pass therethrough when installing the rear frame mount 220.

Elongated apertures 250, 266 are generally laterally elongated perpendicular to the adjustment axis 155. They are also preferably laterally aligned with one another. Further yet, apertures 244, 250, 266 and the opening of yoke 262 are, at least in part, axially aligned as illustrated by axis 268.

In this example notch 240 is positioned between notch 238 and second leg 228. Further, notch 240 is axially offset from notch 238 along the first leg 226.

In one example, the rear rail 146 is formed from stamped and bent sheet metal.

While a set of rear frame mounts 220 and rear rail 146 were described, the same exact explanation applies to the front frame mounts 222 and the front rail 144. However, instead extending rearward beyond a rear side of the rear wall of the rear rail 146, the front frame mounts 222 extend forward of a front side of a front wall of the front rail 144. Further, the front rail 144 is substantially identical to the rear rail 146 except it may be a slight bit shorter as it located between the two front side rail members 160 rather than the two rear side rail members 168.

In operation, the adjustable rack system 106 may be assembled and then lengthwise adjusted when installing into the shelving rack 102. Alternatively, the adjustable frame 140 can be installed and then the adjustable rack 142 can be installed on the adjustable frame 140.

Once the adjustable frame 140 is installed, it need not be removed from the shelving frame 102 and well 112 thereof to provide access to the portion of the well 112 located below the adjustable rack system 106, such as to the bottom 113. Access may be required for cleaning purposes or maintenance purposes, such as to accesses other componentry such as if the shelving system 100 is used as a refrigerated display or a display that includes misters or air curtains (e.g. pumps, valves, controllers, fluid supply lines, cooling units, cooling fluid supply lines, etc.).

Here, the first and second panels 172, 174 can be removed simultaneously from the adjustable frame 140 and without requiring removal of the adjustable frame. This makes the components that are removed, e.g. panels 172, 174, much lighter than prior configurations. Further, by leaving the adjustable frame 140 in place within the shelving frame 102, the proper orientation and height for the adjustable rack system 106 is not inadvertently changed if a user fails to reinstall the frame 140 in the desired mounting apertures 114, 116.

In some examples, the adjustable rack system 106 may be configured such that the first panel 172 can by tilted relative to the second panel 174 and the rear rail 146 such that the first panel 172 can be disconnected from the rear rail 146 while the sliding interlock 180 remains connected. This allows the first panel 172 to be slid toward front edge 134 along the second panel 174 without removing the second panel 174 from the front rail 144. This can allow access to the area below the first panel 172 within the well 112 without requiring removal of the adjustable rack system 106. This can be allowed by providing sufficient clearance within the channels formed by clips 182 and the slide regions 184 and/or providing the clips and/or slide regions 184 and/or main panels 190, 193 with sufficient flexibility.

In some systems 100 as outlined above, such as those that include plenums below the adjustable rack system 106, methods of use include removing one adjustable rack 142 while removing the adjustable frame 140 installed. Thereafter, a plenum under the adjustable rack system 106 may be slid laterally to provide access to the portion of the well below the plenum. This can be done without entirely removing the entire rack system 106.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An adjustable rack system for mounting to a frame assembly of a shelving unit, the adjustable rack system comprising:

an adjustable frame having:

a front rail;

a rear rail being spaced apart from the front rail;

at least one longitudinally adjustable rail interconnecting the front and rear rails, the at least one longitudinally adjustable rail being longitudinally adjustable in length to adjust the spacing between the front and rear rails along an adjustment axis; and an adjustable rack removably attached to the adjustable frame, the adjustable rack defines a top surface, the adjustable rack having:

a first panel defining a rear edge of the adjustable rack; and a second panel defining a front edge of the adjustable rack, the second panel being adjustably positionable relative to the first panel to adjust a spacing between the front and rear edge of the adjustable rack, the top surface is defined in part by each of the first and the second panel;

wherein the at least one longitudinally adjustable rail includes a first and a second side rail interconnecting the front and rear rails, the second side rail being laterally spaced apart from the first side rail; and further comprising an intermediate rail extending between and interconnecting the first and second side rails, the second panel including a channel formed in an underside thereof, the intermediate rail received in the channel.

2. The adjustable rack system of claim 1, wherein:

the first side rail includes a first front side rail member and a first rear side rail member, the first front side rail member is adjustably positionable relative to the first rear side rail member to adjust the length of the first side rail, the first front side rail member is attached to the front rail, and the first rear side rail member is attached to the rear rail; and the second side rail includes a second front side rail member and a second rear side rail member, the second front side rail member is adjustably positionable relative to the second rear side rail member to adjust the length of the second side rail, the second front side rail member is attached to the front rail, and the second rear side rail member is attached to the rear rail.

3. The adjustable rack system of claim 1, wherein the first panel is operably attached to the rear rail and the second panel is operably attached to the front rail such that the first panel and rear rail move together as a unit relative to the front rail and the second panel to adjust spacing between the front and rear edges along the adjustment axis.

4. The adjustable rack system of claim 3, wherein:

each of the first and second side rails includes:

a first rail member and a second rail member;

the first rail member is attached to the front rail;

the second rail member is attached to the rear rail;

the second rail member is slidably connected to the first rail member to adjust the length of the longitudinally adjustable rail and the spacing between the front and rear rails along the adjustment axis;

the first panel is operably attached to the rear rail by being directly attached to the second rail member; and the second panel is operably attached to the front rail by being directly attached to the first rail member.

5. The adjustable rack system of claim 1, wherein the first and second panels are removable from the frame simultaneously as a single unit.

6. The adjustable rack system of claim 1, wherein:

a first panel connector connects the first panel to a rear portion of the adjustable frame, the interaction between the first panel connector and the rear portion of the adjustable frame fixing the first panel relative to the rear portion of the adjustable frame along the adjustment axis; and a second panel connector connects the second panel to a front portion of the adjustable frame, the interaction between the first connector and the front portion of the adjustable frame fixing the second panel relative to the front portion of the adjustable frame along the adjustment axis.

7. The adjustable rack system of claim 6, wherein:

the first panel connector is provided by at least one of a pin, a plug, and/or a projection formed by the first panel; and the second panel connector is provided by at least one of a pin, a plug, and/or a projection formed by the second panel.

8. The adjustable rack system of claim 1, wherein the first panel includes at least one mounting projection extending downward below the top surface, the at least one mounting projection extending into a mounting aperture formed in a rear portion of the adjustable frame, the interaction between the at least one mounting projection and mounting aperture fixing the first panel relative to the rear portion of the adjustable frame along the adjustment axis; and the second panel includes at least one mounting projection extending downward below the top surface, the at least one mounting projection extending into a mounting aperture formed in a front portion of the adjustable frame, the interaction between the at least one mounting projection and mounting aperture fixing the second panel relative to the front portion of the adjustable frame along the adjustment axis.

9. The adjustable rack system of claim 1, wherein:

the first panel includes at least one mounting projection extending downward below the top surface, the at least one mounting projection extending into a mounting aperture formed in the rear rail, the interaction between the at least one mounting projection and mounting aperture fixing the first panel relative to the rear rail along the adjustment axis; and the second panel includes at least one mounting projection extending downward below the top surface, the at least one mounting projection extending into a mounting aperture formed in the front rail, the interaction between the at least one mounting projection and mounting aperture fixing the second panel relative to the front rail along the adjustment axis.

10. The adjustable rack system of claim 1, wherein the first and second panels have a sliding interlock therebetween, when coupled, the sliding interlock permits the first panel to slide relative to the second panel along the adjustment axis but prevents the first and second panels from being disconnected from one another in a direction generally orthogonal to the top surface.

11. The adjustable rack system of claim 10, wherein the sliding interlock includes:

at least one clip provided on one of the first and second panels;

a slide region of the other one of the first and second panels that is slidingly engaged by the at least one clip, the slide region being generally parallel to the adjustment axis.

12. The adjustable rack system of claim 10, wherein the sliding interlock includes:

first and second clips provided by one of the first and second panels, the first and second clips being spaced apart from one another in a lateral direction being generally perpendicular to the adjustment axis;

first and second slide regions provided by the other one of the first and second panels;

the first clip slidingly engaging the first slide region for sliding motion parallel to the adjustment axis but preventing disconnection generally orthogonal to the top surface; and the second clip slidingly engaging the second slide region for sliding motion parallel to the adjustment axis but preventing disconnection generally orthogonal to the top surface.

13. The adjustable rack system of claim 10, wherein the sliding interlock includes:

first and second clips provided by the first panel, each of the first and second clips including a leg extending downward from a first main panel section of the first panel and a foot portion extending laterally from the leg, the foot portion and a bottom of the first main panel section forming a channel therebetween;

first and second slide regions provided by a second main panel section of the second panel, the first slide region received in the channel formed by the first clip and the second slide region received in the channel formed by the second clip.

14. The adjustable rack system of claim 1, wherein the top surface of the adjustable rack includes a plurality of upward extending ribs and a plurality of apertures formed therethrough.

15. A shelving system comprising:

a shelving frame including:

a rear mounting wall extending vertically a first height;

a front mounting wall extending vertically a second height that is less than the first height, the front mounting wall being spaced forward of the rear mounting wall, the rear mounting wall and front mounting wall forming a well therebetween below a top end of the front mounting wall; and an adjustable rack system of claim 1 mounted to the rear mounting wall and the front mounting wall with the front edge of the adjustable rack at or below the top end of the front mounting wall of the shelving frame.

16. The shelving system of claim 15, wherein the adjustable rack of the adjustable rack system is removable from the shelving frame without removing the adjustable frame from the shelving frame; and further comprising a shelf arrangement providing a product support surface, the product support surface being located vertically above the top end of the front wall.

17. The shelving system of claim 15, wherein the rear mounting wall includes a first plurality of vertically spaced mounting apertures and the front mounting wall includes a second plurality of vertically spaced mounting apertures, the adjustable rack system being selectively mountable within the first and second plurality of vertically spaced mounting apertures to adjust a height and/or slant of the adjustable rack system relative to the shelving frame;

further comprising a shelf arrangement providing a product support surface, the product support surface being located vertically above the top end of the front wall;

wherein the rear mounting wall includes a third plurality of vertically spaced mounting apertures that is different than the first plurality of mounting apertures, the shelf arrangement being mounted to the third plurality of vertically spaced mounting apertures;

wherein the third plurality of vertically spaced mounting apertures includes apertures that are vertically above all of the apertures of the first and second plurality of vertically spaced mounting apertures.

18. An adjustable rack system for mounting to a frame assembly of a shelving unit, the adjustable rack system comprising:

an adjustable frame having:

a front rail;

a rear rail being spaced apart from the front rail;

at least one longitudinally adjustable rail interconnecting the front and rear rails, the at least one longitudinally adjustable rail being longitudinally adjustable in length to adjust the spacing between the front and rear rails along an adjustment axis; and an adjustable rack removably attached to the adjustable frame, the adjustable rack defines a top surface, the adjustable rack having:

a first panel defining a rear edge of the adjustable rack; and a second panel defining a front edge of the adjustable rack, the second panel being adjustably positionable relative to the first panel to adjust a spacing between the front and rear edge of the adjustable rack, the top surface is defined in part by each of the first and the second panel;

wherein:

the first panel includes at least one mounting projection extending downward below the top surface, the at least one mounting projection extending into a mounting aperture formed in the rear rail, the interaction between the at least one mounting projection and mounting aperture fixing the first panel relative to the rear rail along the adjustment axis; and the second panel includes at least one mounting projection extending downward below the top surface, the at least one mounting projection extending into a mounting aperture formed in the front rail, the interaction between the at least one mounting projection and mounting aperture fixing the second panel relative to the front rail along the adjustment axis;

wherein:

the at least one mounting projection of the first panel is formed by an annular wall that surrounds an aperture extending through the first panel and through the top surface; and the at least one mounting projection of the second panel is formed by an annular wall that surrounds an aperture extending through the second panel and through the top surface.

19. The adjustable rack system of claim 18, wherein the at least one mounting projections of the first and second panels are sized for receipt of one or more fingers of a user to allow the user to grasp the corresponding first or second panel to remove the adjustable rack from the adjustable frame.

20. The adjustable rack system of claim 18, wherein:

the adjustable frame includes a first rear frame mount, the first rear frame mount includes an exposed portion that extends rearward of a rear side of the rear rail, the exposed portion includes a downward opening notch; and the adjustable frame includes a first front frame mount, the first front frame mount includes an exposed portion that extends forward of a front side of the front rail, the exposed portion includes a downward opening notch.

21. The adjustable rack system of claim 20, wherein:

the rear rail includes a rear wall, the rear wall defines an opening through which the first rear frame mount extends;

the first rear frame mount includes an upward opening notch, the upward opening notch receiving a portion of the rear wall forming part of the opening through which the rear frame mount extends;

the front rail includes a front wall, the front wall defines an opening through which the first front frame mount extends; and the first front frame mount includes an upward opening notch, the upward opening notch receiving a portion of the front wall forming part of the opening through which the front frame mount extends.

22. The adjustable rack system of claim 20, wherein:

the first rear frame mount includes an upward opening notch, the upward opening notch receiving a portion of the rear rail, engagement provided by the notch and the portion of the rear rail preventing movement of the first rear frame mount relative to the rear rail along the adjustment axis; and the first front frame mount includes an upward opening notch, the upward opening notch receiving a portion of the front rail, engagement provided by the notch and the portion of the front rail preventing movement of the first front frame mount relative to the front rail along the adjustment axis.

23. An adjustable rack system for mounting to a frame assembly of a shelving unit, the adjustable rack system comprising:

an adjustable frame having:

a front rail;

a rear rail being spaced apart from the front rail;

at least one longitudinally adjustable rail interconnecting the front and rear rails, the at least one longitudinally adjustable rail being longitudinally adjustable in length to adjust the spacing between the front and rear rails along an adjustment axis; and an adjustable rack removably attached to the adjustable frame, the adjustable rack defines a top surface, the adjustable rack having:

a first panel defining a rear edge of the adjustable rack; and a second panel defining a front edge of the adjustable rack, the second panel being adjustably positionable relative to the first panel to adjust a spacing between the front and rear edge of the adjustable rack, the top surface is defined in part by each of the first and the second panel;

wherein the first and second panels have a sliding interlock therebetween, when coupled, the sliding interlock permits the first panel to slide relative to the second panel along the adjustment axis but prevents the first and second panels from being disconnected from one another in a direction generally orthogonal to the top surface;

wherein the sliding interlock includes:

at least one clip provided on one of the first and second panels;

a slide region of the other one of the first and second panels that is slidingly engaged by the at least one clip, the slide region being generally parallel to the adjustment axis wherein the slide region includes a notch sized to receive the at least one clip therethrough generally orthogonal to the top surface for assembling the sliding interlock.

24. An adjustable rack system for mounting to a frame assembly of a shelving unit, the adjustable rack system comprising:

an adjustable frame having:

a front rail;

a rear rail being spaced apart from the front rail;

at least one longitudinally adjustable rail interconnecting the front and rear rails, the at least one longitudinally adjustable rail being longitudinally adjustable in length to adjust the spacing between the front and rear rails along an adjustment axis; and an adjustable rack removably attached to the adjustable frame, the adjustable rack defines a top surface, the adjustable rack having:

a first panel defining a rear edge of the adjustable rack; and a second panel defining a front edge of the adjustable rack, the second panel being adjustably positionable relative to the first panel to adjust a spacing between the front and rear edge of the adjustable rack, the top surface is defined in part by each of the first and the second panel;

wherein the first and second panels have a sliding interlock therebetween, when coupled, the sliding interlock permits the first panel to slide relative to the second panel along the adjustment axis but prevents the first and second panels from being disconnected from one another in a direction generally orthogonal to the top surface;

wherein the sliding interlock includes:

first and second clips provided by the first panel, each of the first and second clips including a leg extending downward from a first main panel section of the first panel and a foot portion extending laterally from the leg, the foot portion and a bottom of the first main panel section forming a channel therebetween;

first and second slide regions provided by a second main panel section of the second panel, the first slide region received in the channel formed by the first clip and the second slide region received in the channel formed by the second clip;

wherein the second main panel includes a first notch adjacent the first slide region and a second notch adjacent the second slide region, the first and second notches sized and configured such that the foot of the first clip can pass through the first notch to align the first slide region with the channel of the first clip and the foot of the second clip can pass through the second notch to align the second slide region with the channel of the second clip.

25. The adjustable rack system of claim 24, wherein:

the first notch is formed between opposed ends of the first slide region such that a first portion of the first slide region is on a first side of the first notch and a second portion of the first slide region is on a second side of the first notch; and the second notch is formed between opposed ends of the second slide region such that a first portion of the second slide region is on a first side of the second notch and a second portion of the second slide region is on a second side of the first notch.

26. An adjustable rack system for mounting to a frame assembly of a shelving unit, the adjustable rack system comprising:

an adjustable frame having:

a front rail;

a rear rail being spaced apart from the front rail;

at least one longitudinally adjustable rail interconnecting the front and rear rails, the at least one longitudinally adjustable rail being longitudinally adjustable in length to adjust the spacing between the front and rear rails along an adjustment axis; and an adjustable rack removably attached to the adjustable frame, the adjustable rack defines a top surface, the adjustable rack having:

a first panel defining a rear edge of the adjustable rack; and a second panel defining a front edge of the adjustable rack, the second panel being adjustably positionable relative to the first panel to adjust a spacing between the front and rear edge of the adjustable rack, the top surface is defined in part by each of the first and the second panel;

wherein:

the adjustable frame includes a first rear frame mount, the first rear frame mount includes an exposed portion that extends rearward of a rear side of the rear rail, the exposed portion includes a downward opening notch; and the adjustable frame includes a first front frame mount, the first front frame mount includes an exposed portion that extends forward of a front side of the front rail, the exposed portion includes a downward opening notch;

wherein:

the first rear frame mount is removably attached to the rear rail, the first rear frame mount includes a first leg and a second leg extending from the first leg forming an L-shape, the first leg being longer than the second leg, the downward opening notch being formed in the exposed portion of the first leg, the first leg having a second portion located forward of the rear side of the rear rail, the second portion, at least in part, securing the first rear frame mount to the rear rail; and the first front frame mount is removably attached to the front rail, the first front frame mount includes a first leg and a second leg extending from the first leg forming an L-shape, the first leg being longer than the second leg, the downward opening notch being formed in the exposed portion of the first leg, the first leg having a second portion located rearward of the front side of the front rail, the second portion, at least in part, securing the first front frame mount to the front rail.

27. The adjustable rack system of claim 26, wherein:

the rear rail includes a top wall, a bottom wall vertically spaced from the top wall, and a rear wall below the top wall;

the rear wall defines the rear side of the rear rail, the rear wall defines an opening through which the first leg of the first rear frame mount extends;

the bottom wall defines an opening through which the second leg of the first rear frame mount extends;

the front rail includes a top wall, a bottom wall vertically spaced from the top wall, and a front wall below the top wall;

the front wall defines the front side of the front rail, the front wall defines an opening through which the first leg of the first front frame mount extends;

the bottom wall defines an opening through which the second leg of the first front frame mount extends.

28. The adjustable rack system of claim 27, wherein:

the rear rail includes a yoke defining a cavity receiving the second portion of the first leg of the first rear frame mount, the yoke being positioned between the rear wall and the opening in the bottom wall of the rear rail;

the opening in the bottom wall of the rear rail is elongated in a lateral direction and sized to permit the first rear frame mount to be rotated from an orientation wherein the second leg is generally horizontal to an orientation wherein the second leg of the first rear frame mount extends vertically downward to insert the second leg of the of the first rear frame mount into the opening in the bottom wall, insertion of the second leg of the first rear frame mount into the opening in the bottom wall limits motion of the first rear frame mount parallel to the adjustment axis;

the front rail includes a yoke defining a cavity receiving the second portion of the first leg of the first front frame mount, the yoke being positioned between the front wall and the opening in the bottom wall of the front rail; and the opening in the bottom wall of the front rail is elongated in a lateral direction and sized to permit the first front frame mount to be rotated from an orientation wherein the second leg of the first front frame mount is generally horizontal to an orientation wherein the second leg of the first front frame mount extends vertically downward to insert the second leg of the of the first front frame mount into the opening in the bottom wall, insertion of the second leg of the first front frame mount into the opening in the bottom wall limits motion of the first rear frame mount parallel to the adjustment axis.

29. A frame mount for mounting a rack frame to a shelving unit frame, the frame mount comprising:

a first leg and a second leg extending from the first leg in a first direction forming an L-shape, the first leg being longer than the second leg, a first notch being formed in first leg, the notch opening in the first direction;

a second notch, the second notch opening in a second direction being opposite the first direction such that the first and second notches are on opposite sides of the first leg;

wherein:

the second notch is located axially along the first leg between the first notch and the second leg;

the first and second legs are formed from a continuous piece of material; and the continuous piece of material is a bent wire.

* * * * *